US012551940B1

(12) United States Patent
Jordan et al.

(10) Patent No.: US 12,551,940 B1
(45) Date of Patent: Feb. 17, 2026

(54) WIDTH-EXPANDABLE SHOE WITH SPACING PRESET FOR CONDUIT BENDING APPARATUS AND AN ASSOCIATED METHOD

(71) Applicants: David S. Jordan, Clinton, TN (US); Michael C. Jordan, Heiskell, TN (US); Scott M. Jordan, Powell, TN (US)

(72) Inventors: David S. Jordan, Clinton, TN (US); Michael C. Jordan, Heiskell, TN (US); Scott M. Jordan, Powell, TN (US)

(73) Assignee: iTool Equipment Holding LLC, Clinton, TN (US)

( * ) Notice: Subject to any disclaimer, the term of this patent is extended or adjusted under 35 U.S.C. 154(b) by 204 days.

(21) Appl. No.: 18/436,587

(22) Filed: Feb. 8, 2024

Related U.S. Application Data

(63) Continuation-in-part of application No. 18/445,527, filed on Sep. 22, 2023.

(51) Int. Cl.

| | |
|---|---|
| ***B21D 7/024*** | (2006.01) |
| ***B21D 7/02*** | (2006.01) |
| ***B21D 7/022*** | (2006.01) |
| *B21D 7/06* | (2006.01) |

(52) U.S. Cl.
CPC ..... *B21D 7/024* (2013.01); *B21D 7/021* (2013.01); *B21D 7/022* (2013.01); *B21D 7/06* (2013.01)

(58) Field of Classification Search
CPC ..... B21D 7/021; B21D 7/022; B21D 7/025; B21D 7/024; B21D 7/16
See application file for complete search history.

(56) References Cited

U.S. PATENT DOCUMENTS 4,025,749 A * 5/1977 Spurr ..... B23K 11/062 219/84
4,546,632 A * 10/1985 Van Den Kieboom ..... B21D 7/022 72/158
5,187,963 A * 2/1993 Sutton, Jr. ..... B21D 7/02 72/157
5,226,305 A * 7/1993 Adleman ..... B21D 7/024 72/157

(Continued)

FOREIGN PATENT DOCUMENTS

CN 112893549 A * 6/2021 ..... B21D 7/024
EP 1561522 A1 * 8/2005 ..... B21D 7/024
SU 1593731 A1 * 9/1990

*Primary Examiner* — Jared O Brown
(74) *Attorney, Agent, or Firm* — Trenner Law Firm, LLC; Mark Trenner; Michael E. McKee

(57) ABSTRACT

A conduit bending apparatus having a shoe mounted for rotation about an axis and having an arcuate-shaped periphery defining an outwardly-opening groove having sidewalls for closely accepting the outer surface of a conduit desired to be bent utilizes a shoe comprised of a pair of platen half-sections which are joined in a side-by-side relationship and which collectively define the outwardly-opening groove. In addition, the groove has a width as measured laterally across the opening thereof, and the pair of half-sections are joined together in a manner which permits the pair of half-sections to be moved toward and away from one another. The shoe include a spacing preset mechanism adapted to control movement of opposing sidewalls to accommodate a preset alteration in the variable width of the outwardly-opening groove.

16 Claims, 15 Drawing Sheets

(56) References Cited

U.S. PATENT DOCUMENTS

| | | | | |
|---|---|---|---|---|
| 5,284,041 | A * | 2/1994 | Christensen | B21D 7/021 72/157 |
| 5,337,590 | A * | 8/1994 | Schuchert | B21D 7/02 72/157 |
| 11,400,503 | B2 | 8/2022 | Plummer et al. | |
| 2010/0223971 | A1* | 9/2010 | Jaubert | B21D 7/024 72/149 |
| 2016/0354822 | A1* | 12/2016 | Nozu | B21D 37/145 |
| 2017/0291206 | A1* | 10/2017 | Elder | B21D 7/063 |

* cited by examiner

WIDTH-EXPANDABLE SHOE WITH SPACING PRESET FOR CONDUIT BENDING APPARATUS AND AN ASSOCIATED METHOD

CROSS REFERENCE TO RELATED APPLICATIONS

This application is a continuation-in-part of U.S. patent application Ser. No. 18/445,527 filed Sep. 22, 2023 for "Width-Expandable Shoe For Conduit Bending Apparatus And An Associated Method," hereby incorporated by reference in its entirety as though fully set forth herein.

BACKGROUND

This invention relates generally to means and methods for forming a bend in a straight conduit of cylindrical shape and relates, more particularly, to conduit bending apparatus used to form such a bend and to a method of using such apparatus.

The class of conduit bending apparatus with which this invention relates utilizes a conduit bending shoe having an outer periphery which is arcuate in shape and is engageable with a conduit desired to be bent and which is mounted upon a frame for rotation about an axis. Commonly, the arcuate-shaped periphery of the shoe defines at least one outwardly-opening groove which is U-shaped in cross section and whose opening is adapted to closely accept a portion of the outer surface of the conduit desired to be bent. By positioning the shoe against the conduit so that the conduit is accepted by the outwardly-opening groove and then pressing the roller against the conduit while simultaneously rotating the shoe about its rotation axis so that the outer periphery of the shoe moves in rolling engagement along the length of the conduit, a bend is formed in the conduit whose curvature substantially corresponds to the curvature of the shoe periphery.

An example of a conduit bending apparatus of the aforedescribed class is shown and described in U.S. Pat. No. 11,400,503, the disclosure of which is incorporated herein by reference. The conduit bending shoe of this referenced patent includes a set of four arcuate-shaped channels, or grooves, which are each adapted to closely accept the outer surfaces of conduits having an outer diameter (as measured laterally across the opening of the conduit-accepting groove) of a) two inches, b) one and one-half inches, c) one and one-quarter inches and d) one inch, respectively.

For proper operation of a bending apparatus of the aforedescribed class, the sidewalls of an outwardly-opening groove of the shoe must closely hug the outer surface of the conduit being bent. This is because when a bend is formed along the length of the conduit, one-half of a radial cross section of the conduit being bent (i.e. the half closer to the center of the radius of the bend being formed) is exposed to compressive forces while the other, or opposite, one-half of the radial cross section of the conduit being bent (i.e. the half further from the center of the radius of the bend being formed) is exposed to tension forces. Therefore and unless the sidewalls of the outwardly-opening groove closely support, or back, the outer surface of the conduit, the forces (either compressive or tension forces) to which the conduit is exposed could cause an undesirable crimp, kink or wrinkle to form in the conduit during the bending operation. Consequently, a conduit bending apparatus should utilize a conduit bending shoe whose outwardly-opening groove closely matches the outer diameter of the conduit being bent. Preferably, the outer diameter of the conduit-accepting groove sized to accept a conduit having an outer diameter (or trade size) of between 0.5 inches and 2.0 inches must possess a width which is no greater than about 0.005 to 0.05 inches of the outer diameter of the conduit being bent in order to substantially eliminate the likelihood of damage to a conduit being bent by the conduit-accepting groove.

Currently, the outer diameters of conduits capable of being bent with bending apparatus of the aforedescribed class will vary depending upon the material (or materials) comprising the conduit. For example, there is provided below a chart depicting the actual outer diameters (in inches) for RMC (Rigid metallic conduit), IMC (Intermediate metallic conduit) and EMT (Electrical metallic tubing) having a conduit trade size of between 0.5 inches to 2.0 inches:

| Trade Size | RMC | IMC | EMT |
|---|---|---|---|
| 0.5 | 0.84 | 0.815 | 0.706 |
| 0.75 | 1.05 | .029 | 0.922 |
| 1.0 | 1.315 | 1.29 | 1.163 |
| 1.25 | 1.66 | 1.638 | 1.51 |
| 1.5 | 1.9 | 1.883 | 1.74 |
| 2.0 | 2.375 | 2.36 | 2.197 |

Similar charts are available from various conduit manufacturers for RAC (rigid aluminum conduit), conduits comprised of stainless steel and PVC-coated conduit.

The point being made here is that the outer diameters of conduits capable of being bent with conduit bending equipment to which the present invention should be compared are varied and spread over a relatively large range. Consequently and heretofore, an operator of a conduit bending apparatus of this class who is required to bend conduits of different sizes and/or material compositions should also have on hand shoes having conduit-accepting grooves whose widths closely match the outer diameter of every conduit expected to be bent. In practice, such a requirement can necessitate that the operator possess a large number of shoes with conduit-accepting grooves of different widths.

It would be desirable to provide a conduit bending shoe for a conduit-bending apparatus of the aforedescribed class whose outwardly-opening groove defined along the outer periphery of the shoe is not limited for use when bending a conduit whose outer diameter is of a particular, or specific, size and instead, is capable of being used when bending a conduit having an outer diameter which falls within a range of outer diameters.

Another object of the present invention is to provide such a conduit bending shoe whose outwardly-opening groove has a width which is capable of expanding in size from an original width for accepting a conduit having an outer diameter which falls within a range of diameters.

Still another object of the present invention is to provide such a conduit bending shoe whose outwardly-opening groove is capable of expanding in size from an original width for the purpose of adapting, or conforming, the groove to the size of the conduit desired to be bent, even though the conduit can be sightly larger than the original, or unexpanded, size, or width, of the outwardly-opening groove.

Yet another object of the present invention is to provide such a conduit-bending shoe which obviates the need that an operator of the conduit bending apparatus of the aforedescribed class have on hand a large number of shoes whose outwardly-opening groove is capable of closely accepting a conduit possessing a preselected outer diameter.

One more object of the present invention is to provide such a conduit bending shoe which is relatively uncomplicated in structure, yet effective in operation.

Still one more object of the present invention is to provide a new and improved method for bending a conduit with the apparatus of the present invention.

SUMMARY OF THE INVENTION

This invention resides in an improvement to a conduit bending apparatus and a method of use wherein the apparatus includes a conduit-bending shoe mounted for rotation about an axis and has an arcuate-shaped periphery defining an outwardly-opening groove having opposing sidewalls for accepting the outer surface of a conduit desired to be bent. Furthermore, the outwardly-opening groove has a width as measured across the opening thereof and which is sized to accept the outer surface of a conduit having a predetermined outer diameter so that by positioning the outwardly-opening groove of the shoe against a conduit having a predetermined outer diameter so that the outer surface of the conduit is accepted by the sidewalls of the outwardly-opening groove and then pressing the shoe against the conduit while rotating the shoe about its axis of rotation so that the outwardly-opening groove rolls along the length of the conduit, a bend is formed in the conduit.

The improvement to the apparatus is characterized in that the width of the outwardly-opening groove of the shoe is capable of expanding in size to enable the variable width of the outwardly-opening groove of the shoe to accept the conduit regardless of which of the different diameters of conduit is provided.

In an example, a spacing preset mechanism is adapted to control movement of opposing sidewalls of the outwardly-opening groove toward and away from one another to accommodate a preset alteration in the variable width of the outwardly-opening groove.

In an example, the spacing preset mechanism includes one or more preset surface to accommodate the preset alteration in the variable width of the outwardly-opening groove.

The improvement to the method of the invention is characterized in that the step of pressing the outwardly-opening groove of the shoe against the conduit includes a simultaneous step of automatically changing the variable width of the outwardly-opening groove of the shoe to accept the conduit regardless of which of the different diameters of conduit is provided.

In an example, the step of changing the width of the outwardly-opening groove is effected as the two opposing sidewalls of the groove are pressed against the outer surface of the conduit up to a preset surface of a spacing preset mechanism, each of the preset surfaces corresponding to different industry-standard conduit diameters.

DETAILED DESCRIPTION OF THE ILLUSTRATIVE EMBODIMENTS

Figure 1:
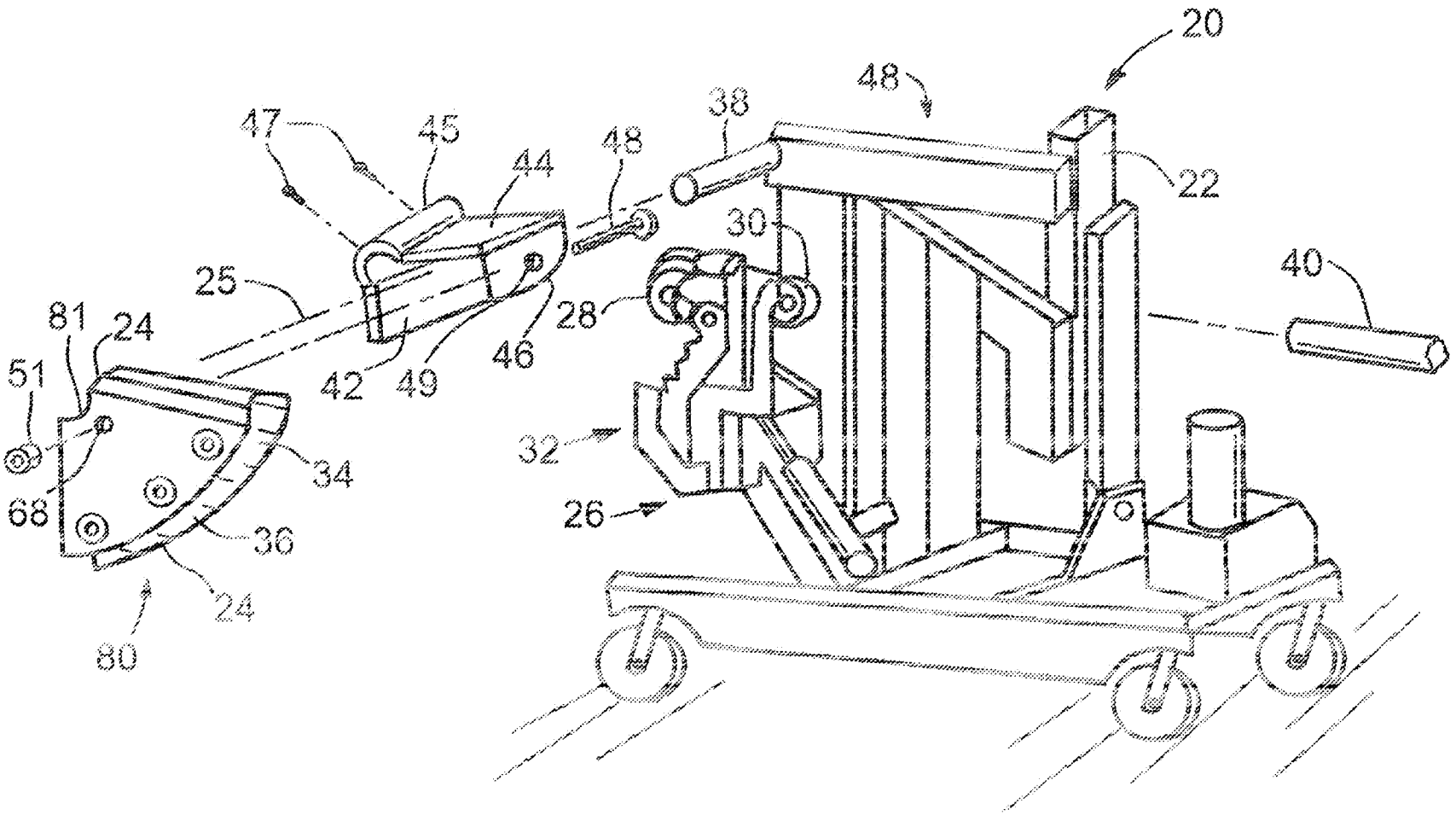
FIG. 1 is a perspective view of a conduit bending apparatus within which features of the present invention are incorporated, shown exploded.

Turning now to the drawings in greater detail and considering first FIG. 1, there is schematically illustrated a power bending apparatus, generally indicated 20, within which features of the present invention are incorporated and which is capable of bending a conduit 40 of cylindrical shape. Briefly, the bending apparatus 20 includes a frame 22 and a conduit bending shoe, or shoe assembly, 24 which is mounted for rotation upon the frame 22 about a substantially horizontal axis 25 and a pressure roller assembly 26 which is supported by the frame 22 beneath the shoe 24. The pressure roller assembly 26 includes a plurality of rollers 28, 30 which are horizontally spaced from one another and which are supported for rotation about parallel axes which are each disposed substantially parallel to the horizontal axis 25 about which the shoe 24 is permitted to rotate during a conduit bending operation.

The shoe 24 of the depicted apparatus 20, described in greater detail herein, has a peripheral edge 34 which defines an outwardly-opening groove 36 which is substantially U-shaped in cross section and whose U-shape opens radially away from the rotation axis 25 of the shoe 24 for closely accepting the outer surface of a conduit 40 (FIG. 1) desired to be bent by the bending apparatus 20. As used herein, the phrase closely accepting is intended to mean that the outwardly-opening groove 36 is fitted about a conduit in a snug relationship so that the width of the groove opening closely matches the outer diameter of the conduit about which the groove 36 is positioned. In practice—and for conduits having a trade size of 2.5 inches, the width of the outwardly-opening groove 36, when in an expanded condition (if necessary) and positioned about the outer surface of a conduit, does not exceed the actual outer diameter of the conduit by more than about 0.05 inches.

Meanwhile, the pressure rollers 28, 30 are mounted upon a linkage assembly, generally indicated 32, to permit the pressure rollers 28, 30 to be bodily moved (e.g. manually or hydraulically) relative to the base frame 22 between a lowered position (i.e. a condition of non-use) and a raised position (i.e. a condition of use) at which the spaced-apart pressure rollers 28, 30 are disposed beneath and in relatively close proximity to the peripheral edge 34 of the shoe 24.

The apparatus 20 further includes a horizontally-disposed, cylindrically-shaped load bar 38 upon which the shoe 24 is mounted for rotation about the rotation axis 25. A pair of support plates 42, 44 are arranged in the shape of a V and held thereat by way of a member 45 which is sized to accept (a portion of) the load bar 38 and are fixedly secured about the load bar 38 by way of set screws 47 which extend through the member 45 so that the support plates 42, 44 must rotated with the load bar 38 about the rotation axis 25, and an end plate 46 is secured across one end of the pair of plates 42, 44 to effectively cap one end of the V-shaped arrangement thereof. As will be apparent herein, the shoe 24 is captured between the V-shaped arrangement of plates 42, 44 and bolted to the end plate 46 to thereby slave the shoe 24 to the load bar 38 so that rotation of the load bar 38 about the rotation axis 25 effects a corresponding rotation of the shoe 24 about the axis 25.

The apparatus 20 also includes means, generally indicated 48 in FIG. 1, for forcibly rotating the load bar 38 about the rotation axis 25. Such rotating means 48 can take any of a number of forms, such as electrically or hydraulically-operated means for providing rotating power to the load bar 38. Moreover, such rotating means 48 can be connected to the load bar 38 by way of suitable linkage assemblies (not shown) so that actuation of an electric motor or a hydraulic cylinder effects the forced rotation of the load bar 38 (and the shoe 24 supported thereby) about the rotation axis 25. Electrical power, if needed for operation of the apparatus 20, can be supplied by way of a cord capable of being plugged into an electrical outlet or can be supplied by way of a battery pack to render the apparatus 20 cordless.

The operation of a conduit bending apparatus 20 (of the class to which this invention relates) is well known in the art so that a detailed description of its operation is not believed to be necessary. Suffice it to say that a cylindrical conduit 40 (FIG. 1) which is desired to be bent is positioned lengthways across the upwardly-facing surfaces of the spaced-apart pressure rollers 28, 30, and the roller assembly 26, with the spaced-apart pressure rollers 28, 30, are bodily moved from the lowered condition of non-use to the raised condition of use (as shown in FIG. 1) at which the conduit 40 is held, or squeezed, between the upwardly-facing surfaces of the pressure rollers 28, 30 of the roller assembly 26 and the arcuate edge 34, or more specifically, the surface of the outwardly-opening groove 36, of the shoe 24. By maintaining pressure downwardly upon the conduit 40 (by way of the shoe 24) and simultaneously rotating the shoe 24 about its rotation axis 25 so that its arcuate edge 34 rolls, or moves axially, relative to and along the length of the conduit 40, a bend is formed in the conduit 40 which approximates the curvature of that of the arcuate edge 34 of the shoe 24. It will be understood that the rotation axis 25 of the shoe 24 is intended to remain stationary throughout a conduit bending operation while the conduit 40 is pulled endwise beneath the shoe 24 as the downwardly-applied pressure of the shoe 24 maintains the shoe 24 in frictional gripping engagement with the conduit 40.

For a more detailed description of the operation of a known conduit bending apparatus of the class to which the depicted apparatus 20 can be compared (i.e. one which utilizes a conduit bending shoe and spaced-apart rollers across which the conduit to be bent is positioned), reference can be had to the conduit bending apparatus which is shown and described in earlier-referenced U.S. Pat. No. 11,400,503, the disclosure of which is incorporated herein by reference.

A conduit 40 which is capable of being bent with the bending apparatus 20 can be constructed of any of a number of materials, such as steel, stainless steel or aluminum and can be coated with a suitable coating, such as PVC (polyvinyl chloride). The bending apparatus 20 is capable of bending conduit commonly utilized for sheathing electrical wires routed through the center of the conduit. Accordingly, the classes of conduits capable of being bent by the apparatus 20 include, but are not limited to, EMT (electrical metal tubing), IMC (intermediate metal conduit), RAC (rigid aluminum conduit), stainless steel, and PVC coated conduit.

Figure 3:
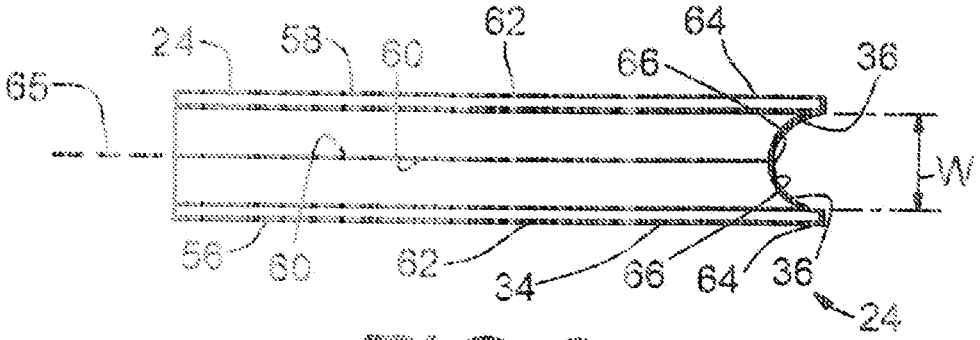
FIG. 3 is an end elevation view of the two half-sections of the shoe of FIG. 2, shown positioned in a side-by-side, or layup, arrangement before assembly.
Figure 6:
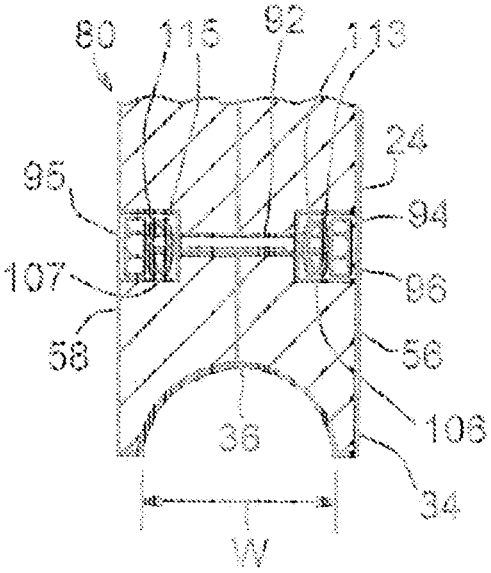
FIG. 6 is a view of a fragment of the cross-sectional view of the shoe depicted in FIG. 5, when assembled.

With reference to FIGS. 3 and 6 and for a reason which will be apparent herein, the radially outwardly-opening groove 36 of the shoe 24 has an original, or unexpanded, width W (as measured laterally across the opening of the groove 36) which is capable of expanding in size to closely accept a conduit having a diameter which is greater than the original width W of the groove 36. In this connection, the shoe 24 is comprised of a plurality of, or multiple, sections (described herein) which are joined together adjacent the arcuate-shaped peripheral edge 34 of the shoe 24 and which collectively define the outwardly-opening groove 36 of the shoe 24. Furthermore, the multiple sections are capable of moving relative to one another (e.g. moving further apart) from the original, or unexpanded, condition (as viewed in FIG. 3) to thereby increase the width of the outwardly-opening groove 36 from the original width W. As will be apparent herein, the capacity of the shoe 24 to expand in width enables the outwardly-opening groove 36 to snugly or closely accept, the outer surface of a conduit whose diameter falls within a range of outer diameters and more specifically, a conduit whose diameter is greater than the original width W.

Figure 2:
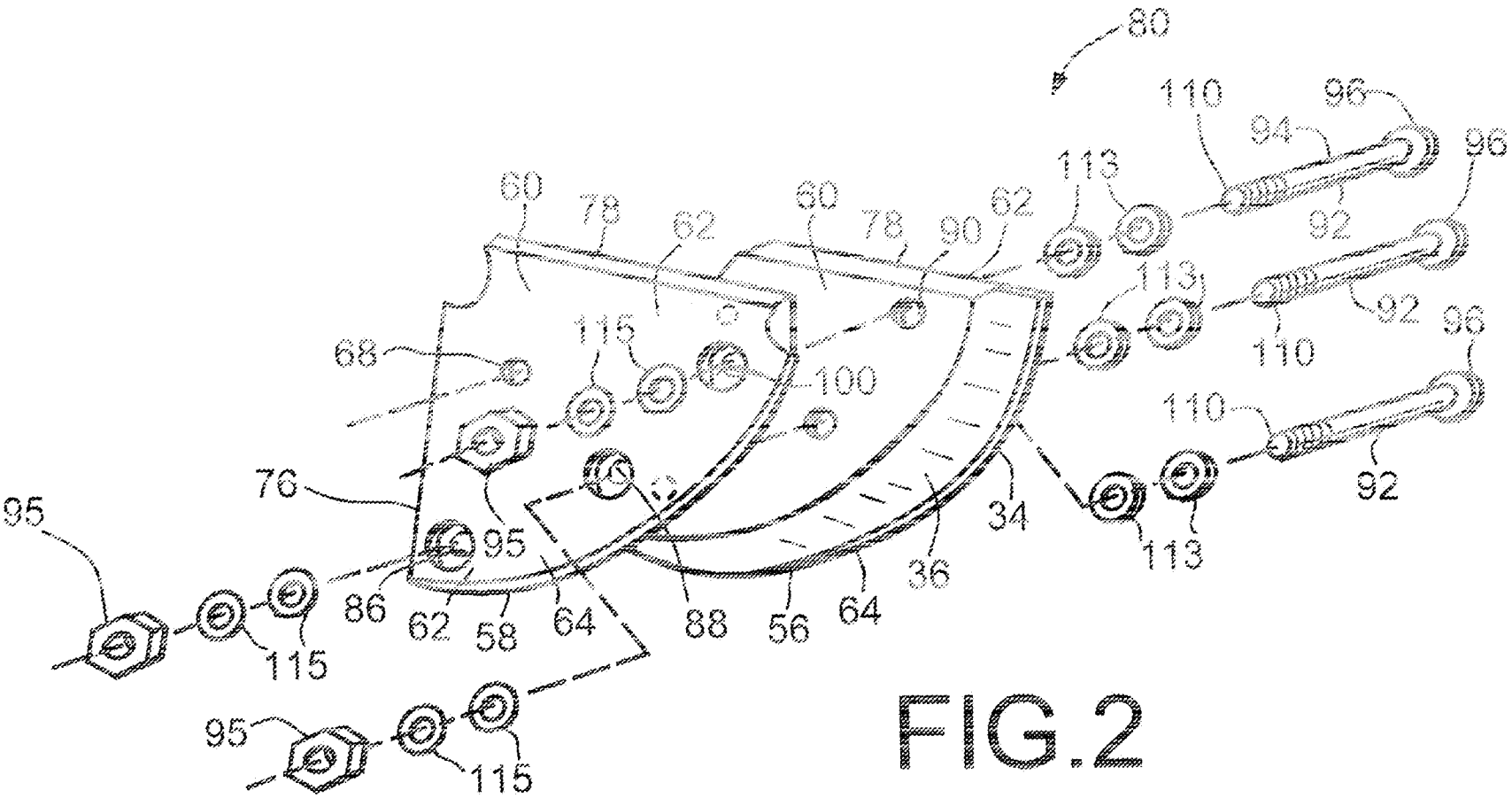
FIG. 2 is a perspective view of the conduit bending shoe of the FIG. 1 apparatus, shown exploded.
Figure 4:
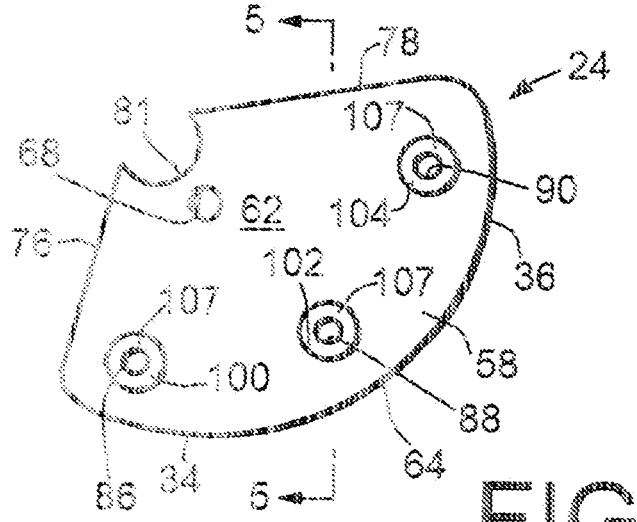
FIG. 4 is a top plan view of the two half-sections of the FIG. 2 shoe, as seen from above in FIG. 3.

Within the depicted apparatus 20 and with reference to FIGS. 2-5, the shoe 24 includes a pair of platen half-sections 56, 58 which each define two opposite sector-shaped side surfaces 60, 62 and an arcuate periphery 64 which defines an outwardly-opening groove 66 (FIG. 3) whose cross-section resembles (in appearance) the shape of a C. When the half-sections 56, 58 are positioned in a side-by-side, or lay-up, relationship with one another (as best shown in FIGS. 2 and 3) so that the side surfaces 60 thereof are positioned in opposition to (and flushly engage) one another (as best shown in FIG. 3), the C-shaped grooves 66 defined along the sector peripheries 64, 64 cooperate to collectively define the outwardly-opening U-shaped groove 36 which extends along the entirety of the arcuate peripheral edge 34 of the shoe 24. Meanwhile, the outwardly-opening groove 36 is provided with two opposing sidewalls 50 and 52, and the C-shaped groove 66 of one half-section 56 defines the conduit-engaging surface of one sidewall 50 of the groove 36, and the C-shaped groove 66 of the other half-section 58 defines the conduit-engaging surface of the other sidewall 52 of the groove 36. Meanwhile, each of the platen half-sections 56 or 58 includes planar edges 76 and 78 (FIG. 4) which converge toward one another (from the periphery 64 of the half-sections 56 or 58 to a semi-circular-shaped cutout 81 which accommodates the positioning of the shoe 24 against the cylindrical surface of the load bar 38 when the shoe 24 is mounted thereon.

As will be apparent herein and when the shoe 24 is in a fully assembled (and unexpanded) condition, the half-sections 56, 58 are positioned in the side-by-side, or layup arrangement as shown in FIG. 3, the shoe 24 can be said to define a mid-plane 65 (FIG. 3) which bisects the U-shaped groove 66 along the entire length of the shoe periphery 34, and this mid-plane 65 could be fairly regarded as being parallel to one side surface (i.e. the surface 60) of each half-section 56 or 58). Stated another way and with regard to the FIG. 3 arrangement, one half-section 56 is disposed on one side of the mid-plane 65, and the other half-section 58 is disposed on the other side of the mid-plane 65.

Figure 10:
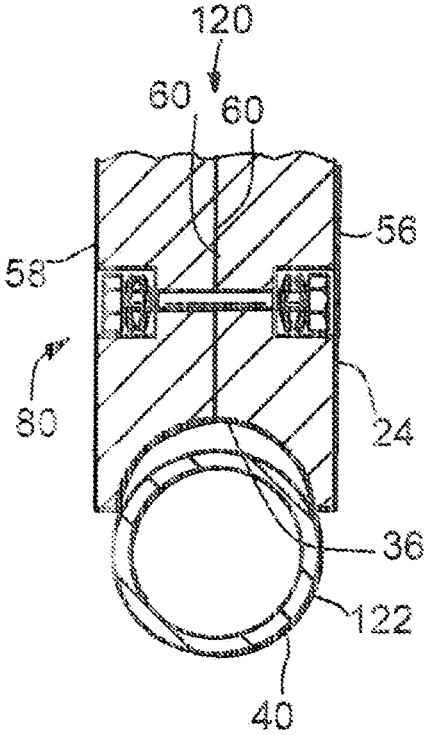
FIGS. 10 and 11 are cross-sectional views of the assembled FIG. 2 shoe as seen in FIG. 6 depicting, in sequence, the expansion in width of the outwardly-opening groove of the FIG. 2 shoe as the opposing sidewalls of the outwardly-opening groove of the shoe are urged downwardly against the outer surface of a conduit having a larger diameter than the original width of the outwardly-directed groove.
Figure 11:
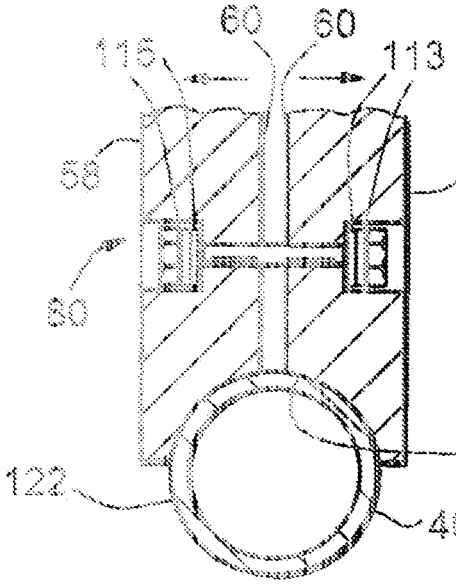
Figure 9:
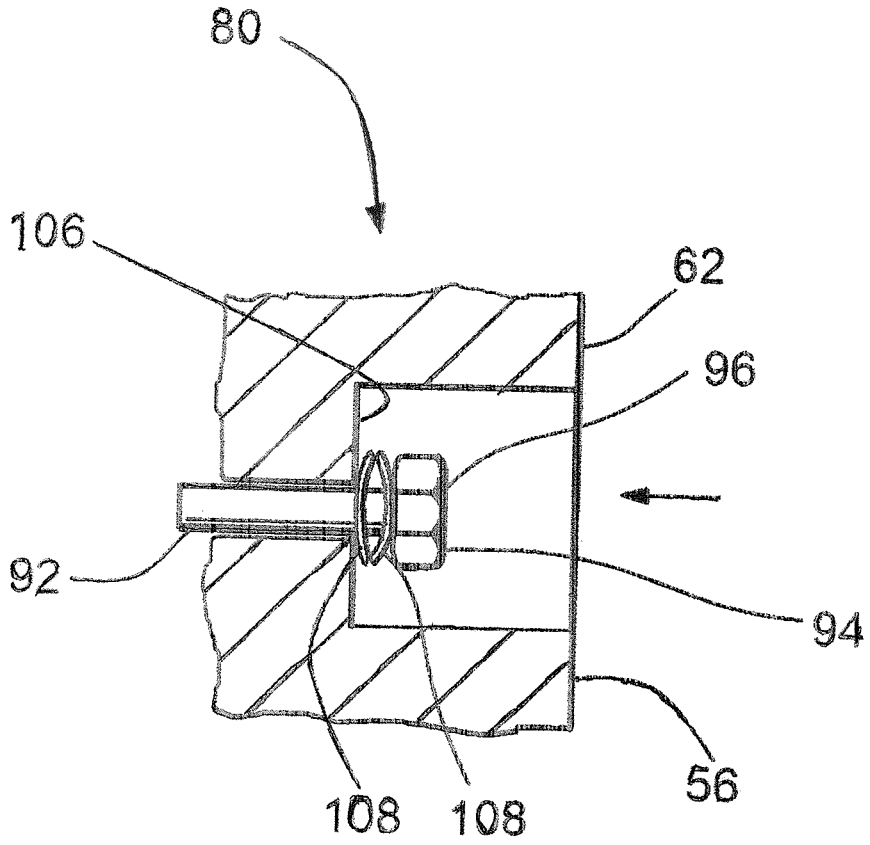
FIG. 9 is a view of a fragment of the cross-sectional view of FIG. 6, drawn to a slightly larger scale.

It will also be apparent herein that the two half-sections 56, 58 are joined together in a manner described herein which permits the movement of the half-sections 56, 58 relative to one another between the illustrated FIG. 3 side-by-side condition at which the opposing surfaces 60 of the half-sections 56, 58 are arranged in flush engagement with one another (as shown in FIGS. 3 and 10) and a fully expanded condition, as depicted in FIG. 11, at which the opposing surfaces 60 are spaced from one another.

With reference to FIGS. 2 and 5-11, it is also a feature of the shoe 24 that it includes means, generally indicated 80 in FIGS. 5-11, for continually biasing the half-sections 56, 58 (and in particular, the surfaces 60 thereof) from a fully expanded condition (such as is illustrated in FIG. 11) at which the surfaces 60 are spaced from one another toward the unexpanded condition (as illustrated in FIG. 10). In connection with the foregoing and with reference again to FIG. 2, the half-sections 56, 58 define three sets of aligned through-openings 86, 88, 90 for accepting the shanks, indicated 92, of bolts 94 directed endwise therethrough and which are fastened through the half-sections 56, 58 with a nut 95 which is threaded upon the shank 92 of each bolt 94 opposite the head end thereof. In addition, each side surface 62 of the half-section 56 is provided with a circular recess 101 (best shown in FIG. 5) which is centered about and surrounds a corresponding opening 86, 88 or 90, and each recess 101 is provided with a bottom 106. Similarly, the side surface 62 of the half-section 58 is provided with a circular recess 100, 102 or 104 (best shown in FIG. 4) which is centered about and surrounds a corresponding opening 86, 88 or 90, and each recess 100, 102 or 104 is provided with a bottom 107.

The half-sections 56, 58 also define a fourth set of aligned through-openings 68 (FIG. 2) adjacent the cutout 81 for purposes of securing the shoe 24 to the load bar 38 by way of the earlier-described arrangement of support and end plates 42, 44, 46 which are fixedly secured to the load bar 38. In this connection, the end plate 46 defines a through-opening 49 (FIG. 1), and the shoe 24 is positioned within the V-shaped arrangement formed between the support plates 42 and 44, and the shoe 24 is positioned against the end plate 46 so that the set of aligned through-openings 68 provided in the half-sections 56, 58 are aligned with the through-opening 49 provided in the end plate 46. A bolt 55 (FIG. 1) is then directed shank-end-first through the aligned through-openings 49 and 68, and a nut 51 is tightly secured about the shank of the bolt 48 opposite the head end thereof. It follows that with the support and end plates 42, 44 and 46 fixedly secured to the load bar 38 (and captured between the support plates 42 and 44) and the shoe 24 fixedly secured to the end plate 46, the shoe 24 is slaved to the load bar 38 so that forced rotation of the load bar 38 about the rotation axis 25 effects the forced rotational movement of the shoe 24 about the rotation axis 25.

As will be apparent herein, each of the three bolts 94 (FIG. 2) is directed through a corresponding set of aligned through-openings 86, 88, 90 (FIG. 2) for joining the half-sections 56 and 58 together between the head, indicated 96, of the bolt 94 and a nut 95, and the biasing means 80 includes a compression-style spring 108 having a central opening 109 (FIGS. 7 and 8) through which the shank 92 of a bolt 94 extends. More specifically and with reference to FIGS. 8 and 9, the spring 108 has two opposite ends (or side faces 116, 118) which are spaced from one another along the shank 92 of the bolt 94 and is adapted to resist compressive forces which squeeze, or compress, the body of the spring 108 between the opposite ends thereof toward a flattened condition.

One spring washer which is suitable for use as the spring washer 108 is referred to in the art as a Belleville spring washer and is available from W. W. Grainger, Inc. of Lake Forest, Illinois under Catalogue Item 22RD19, but other classes of spring washers, such as those known in the industry as wave washers or lock washers can be used as the spring 108.

Within the shoe 24 of the depicted conduit bending apparatus 20, the spring washer 108 of the biasing means 80 is provided by a first pair of spring washers 113 and a second pair of spring washers 115 which are each positioned about the shank 92 of a bolt 94 for acting between the opposite ends of the bolts 92. As will be apparent herein, each spring washer of the two pairs of spring washers 113, 115 possesses an inherent resiliency so that the bodies of the washers 113, 115 resist (and thus oppose) compressive forces which tend to deform the washers 113, 115 toward a flattened condition (as best viewed in FIG. 11). It follows that each spring washer 113 or 115 is provided with an original thickness when in an undeformed condition but possesses a smaller thickness (i.e. a thickness which is smaller than the original thickness) when its opposite side faces are squeezed together toward a flattened condition. Consequently, when positioned about the shank 92 of a bolt 94 and before the washers 113, 115 are pressed toward a flattened condition), each washer 113 or 115 provides a spacer of predetermined thickness along the shank 92 of the bolt 94 (i.e. between the head, indicated 96, of the bolt 94 and the nut 95 which is screwed upon the shank end of the bolt 94). Such a spacing, or thickness, is, of course, reduced when the opposite side faces of the washers 113, 115 are pressed toward a flattened condition.

Figure 5:
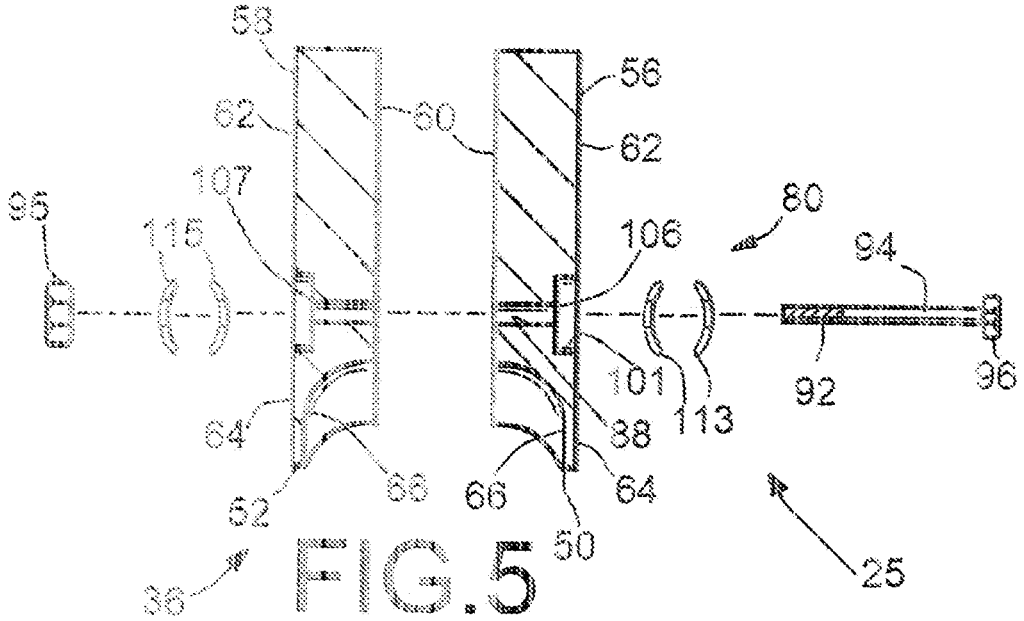
FIG. 5 is a cross-sectional view of the FIG. 2 shoe taken along line 5-5 of FIG. 3 and illustrates a fastener and spring washers used for joining the two half-sections of the shoe together.
Figure 8:
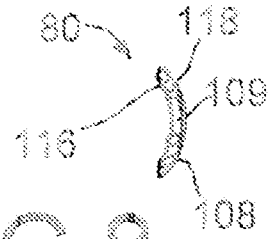
FIG. 8 is a cross-sectional view of the washer of FIG. 7 taken along line 8-8 of FIG. 7.
Figure 7:
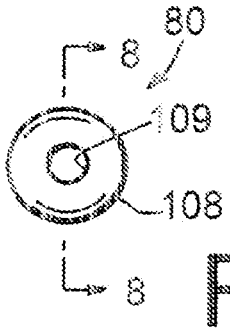
FIG. 7 is a side elevation view of an exemplary spring washer used when joining the two half-sections of the FIG. 2 shoe together.

When assembling the shoe 24 and with reference to FIGS. 2 and 5, the first pair of spring washers 113 are positioned about the shank 92 of each of the three bolts 94, and then each of the three bolts 94 is directed shank-end-first into a corresponding set of openings 100, 102 or 104 until the first pair of washers 113 (which are positioned about the bolt shank 92) come to rest against the bottom 106 of the corresponding recess 101 which opens out of the half-section 56 so that the washers 113 are positioned against the recess bottom 106 and the head 96 of the bolt 94. The second pair of spring washers 115 are then positioned about the end, indicated 110, of the bolt shank 92 opposite the head 96 which protrudes out of the half-section 58 by way of the corresponding set of through-openings 86, 88 or 90, and then a nut 95 is screwed about the end 110 of the bolt shank 92. As exemplified by the assembled arrangement of the shoe 24 depicted in FIG. 6, the first pair of washers 113 are captured about the bolt shank 92 between the head 96 of the bolt 94 and the recess bottom 106, and the second pair of washers 115 are captured about the bolt shank 92 between the nut 95 and the bottom 107 of a corresponding recess 100, 102 or 104 (FIG. 4) which opens out of the surface 62 of the half-section 58.

As best shown in FIG. 6, the nuts 95 are preferably tightened about the bolts 94 only to the point that the washers 113, 115 of each pair of spring washers are held in a stationary condition along the length of the bolt shank 92 and so that the original thickness of each washer 113 or 115, when in an undeformed condition, is substantially preserved. In other words, care is taken not to over-tighten the nuts 95 about the bolt shanks 92 so that the washers 113, 115 are deformed to the FIG. 11 flattened condition.

During a conduit-bending operation and as the sidewalls 50, 52 of the groove 36 of the shoe 24 are urged downwardly (e.g. in the direction of the FIG. 10 arrow 120) against a conduit 40 having an outer diameter which is greater than the original width W (FIG. 6) of the outwardly-opening groove 36, the groove sidewalls 50, 52 of the half-sections 56, 58 (which make the shoe's initial contact with the conduit 40) are forced to slide (e.g. downwardly) along the outer surface, indicated 122 in FIGS. 10 and 11) of the conduit 40 (and on opposite sides thereof) so that the groove sidewalls 50, 52 are forced to spread apart. Such a spreading apart of the sidewalls 50, 52 effects a compressing of the washers 113, 115 toward a flattened condition as the spacing, as measured along the bolt shank 92 between the bolt head 96 and the nut 95, is decreased by a corresponding amount. As the washers 113, 115 are thereby compressed—and due to the inherent resiliency of the washers 113, 115, the washers 113, 115 urge the half-sections 56, 58 toward one another.

It will be understood that as the shoe 24 is rotated about the rotation axis 25 and makes its initial contact with the outer surface 122 of a conduit 40, the half-sections 56, 58 will not likely spread apart in a uniform manner. In other words, the washers 113, 115 which are positioned about the three bolts 94 will not likely be compressed in unison as the groove sidewalls 50, 52 are forced apart as they slide (e.g. downwardly) about and roll along the outer surface 122 of the conduit 40. However, the more of the shoe groove 36 that is rolled along the outer surface 122 of the conduit 40, the more the washers 113, 115 which are positioned about the several bolts 94 will be affected (i.e. compressed) during a conduit bending operation.

It follows from the foregoing that a conduit bending apparatus 20 has been described which embodies a conduit bending shoe 24 comprised of two half-sections 56, 58 having arcuate peripheries 64 which collectively provide a conduit-accepting groove 36 having an original, or unexpanded, width W which is capable of expanding and ultimately closely accepting the outer surface 122 of a conduit 40 (FIGS. 10 and 11) whose outer diameter is greater than the original width W. To this end, one half-section 56 provides one sidewall 50 of the groove 36 while the other half section 58 provides the other sidewall 52 of the groove 96. Meanwhile, biasing means 80, in the form of spring washers 113, 115 are positioned about the shanks 92 of the bolts 94 used to secure the half-sections 56 and 58 together so that the half-sections 56, 58 are continually biased from the FIG. 11 expanded, or spaced-apart, condition toward the FIG. 10 unexpanded condition at which the opposing surfaces 60 of the half-sections 56 and 58 engage one another. As the sidewalls 50, 52 of the groove 36 are forced to spread apart as the sidewalls 50, 52 are urged downwardly (in the direction of the FIG. 10 arrow 120) along the outer surface 122 of the conduit 40, the half-sections 56, 58 are forced to move apart (in opposition to the biasing force of the spring washers 113, 115) so that the width of the groove 36 (as measured laterally across the opening of the groove 36) expands so that the conduit 40 can be closely accepted by the groove 36, as is depicted in FIG. 11.

By way of example, applicants have constructed a shoe 24 with a first pair of spring washers 113 and a second pair of spring washers 115 which are capable of collapsing through a distance of 0.38 inches. Therefore, the groove 36 of such a constructed shoe 24 will accommodate a conduit 40 whose width is 0.38 inches larger than the original, or unexpanded, width W of the groove 36. It can therefore be said that the groove 36 of such a constructed shoe 24 is capable of closely accepting the outer surface 122 of a conduit 40 having an outer diameter which measures between W and 0.38 inches larger than the original groove width W.

It will be understood that numerous modifications and substitutions can be had to the aforedescribed embodiment 20 without departing from the spirit of the invention. For example, although the aforedescribed embodiment 20 has been shown and described as including two pairs of spring washers 113, 115 for biasing the half-sections 56, 58 toward one another as the groove sidewalls 50, 52 are forced to spread apart as the sidewalls 60, 62 are forced downwardly upon (or across) the outer surface 122 of a conduit 40 whose outer diameter is greater than the original width W of the groove 36, a conduit bending shoe can posses an alternative number of spring washers whose biasing strength is different (i.e. greater or lesser) than those of the aforedescribed washers 113, 115. Such an alternative number of washers can be desired if the spacing as measured along the shank 92 of the bolt 94 between the bolt head 96 and the nut 95 is desired to be increased or decreased; and washers having an alternative biasing strength than those of the washers 113 or 115 can be utilized if the strength needed to spread the half-sections 56, 58 apart is desired to be altered.

Figure 12:
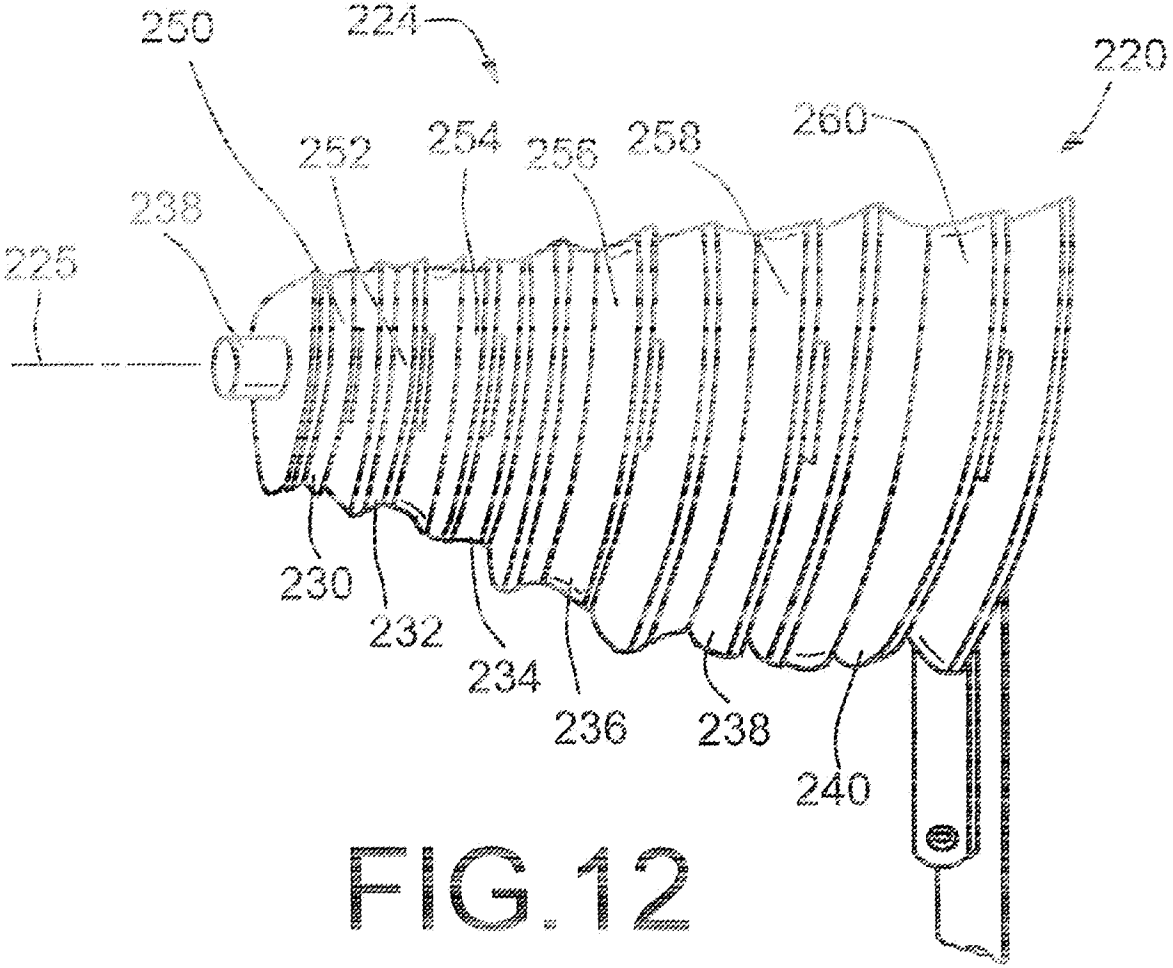
FIG. 12 is a perspective view of a fragment of an alternative conduit bending apparatus within which a series of width-expandable shoes possessing conduit-accepting grooves of alternative sizes are incorporated.

Furthermore and with reference to FIG. 12, there is illustrated an alternative conduit bending apparatus, generally indicated 220, having a conduit bending shoe assembly, generally indicated 224, which is supported about and slaved to a cylindrical load bar 238 for rotation about a rotation axis 225. The shoe assembly 224 of the depicted apparatus 220 includes a series of width-expandable shoes 230, 232, 234, 236, 238 and 240 wherein each shoe 230, 232, 234, 236, 238 or 240 possesses a construction similar to that of the shoe 24 of FIG. 1. In particular, each shoe 230, 232, 234, 236, 238 or 242 possesses two half-sections which collectively define an outwardly-opening groove 250, 252, 254, 256, 258 or 260, respectively, and each groove 250, 252, 254, 256, 258 or 260 has an original, or unexpanded, width which is different from (i.e. larger or smaller) than the original width of every other groove 250, 252, 254, 256, 258 or 260 in the series of shoes 230, 232, 234, 236, 238 and 240. It therefore follows that the series of shoes 230, 232, 234, 236, 238 and 240 depicted in FIG. 12 provides an operator with the capacity to bend a large number of conduits having any outer diameter which falls within a relatively large range of different outer diameters. Thus, the apparatus 220 is likely to obviate the need that an operator have on hand a separate conduit bending shoe for every size of conduit that may be required to bend and is advantageous in this respect.

Furthermore, although the biasing means 80 of the afore-described apparatus 20 has been described as taking the form of spring washers 113, 115, such biasing means can take an alternative form, such as that of a compression spring or an elastomeric member (e.g. a washer) which possesses an inherent resiliency to return to an undeformed condition when compressed. When suitably arranged between the half-sections 56 and 58, these alternative forms of biasing means are capable of performing the same biasing function as that of the spring washers 113, 115.

Figure 13:
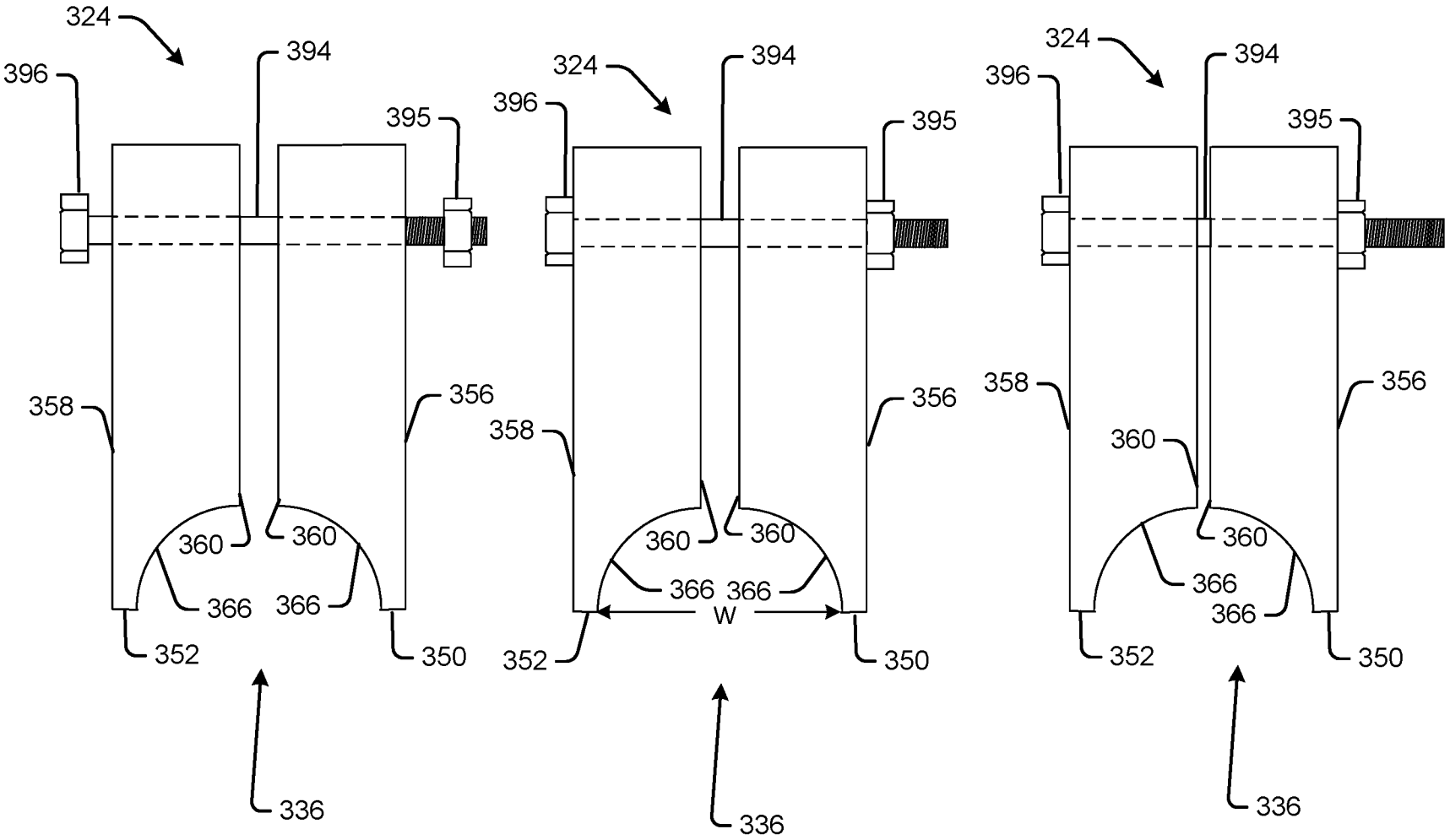
FIG. 13 shows a conduit-bending shoe for a conduit bending apparatus having a shank and an example means associated with the shank for limiting the expansion of the width of the outwardly-opening groove.

FIG. 13 shows another conduit-bending shoe 324 for a conduit bending apparatus. The conduit-bending shoe 324 includes a plurality of sections 356, 358 arranged adjacent the arcuate-shaped periphery thereof which collectively define the outwardly-opening groove 336 of the shoe 324. One of the sections 356, 358 provides an opposing sidewall of the outwardly-opening groove 336, and another of the sections 356, 358 provides the other opposing sidewall of the outwardly-opening groove 336. The sections 356, 358 are movable relative to one another for altering the width W of the outwardly-opening groove 336.

In FIG. 13, the sections 356, 359 are shown movable relative to one another along the length of at least one shaft or shank 394. The conduit-bending shoe 324 also includes means associated with the shank 394 for limiting the expansion of the width W of the outwardly-opening groove 336. The means for limiting the expansion of the width W is cooperable with the shank 394 for limiting the distance along the length of the shank 394 that the sections 356, 358 are permitted to travel as the width W of the outwardly-opening groove 336 is expanded. By limiting the distance along the length of the shank 394 that at least one of the sections 356, 358 is permitted to travel, the width W of expansion of the outwardly-opening groove 336 is limited as well.

In an example, the shank 394 has two opposite ends and is provided by the shank 394 of a headed fastener having a nut 395 at one end of the shank 394 and a head 396 at the other end of the shank 394. The sections 356, 358 are permitted to travel along the length of the elongated shank 394 and between the nut 395 and the head of the fastener shank 394 as the width of the outwardly-opening groove 336 is altered. It should be noted that the nut 395 or the head 396 may be affixed (e.g., welded) to a corresponding one of the sections 356, 358.

Figure 14:
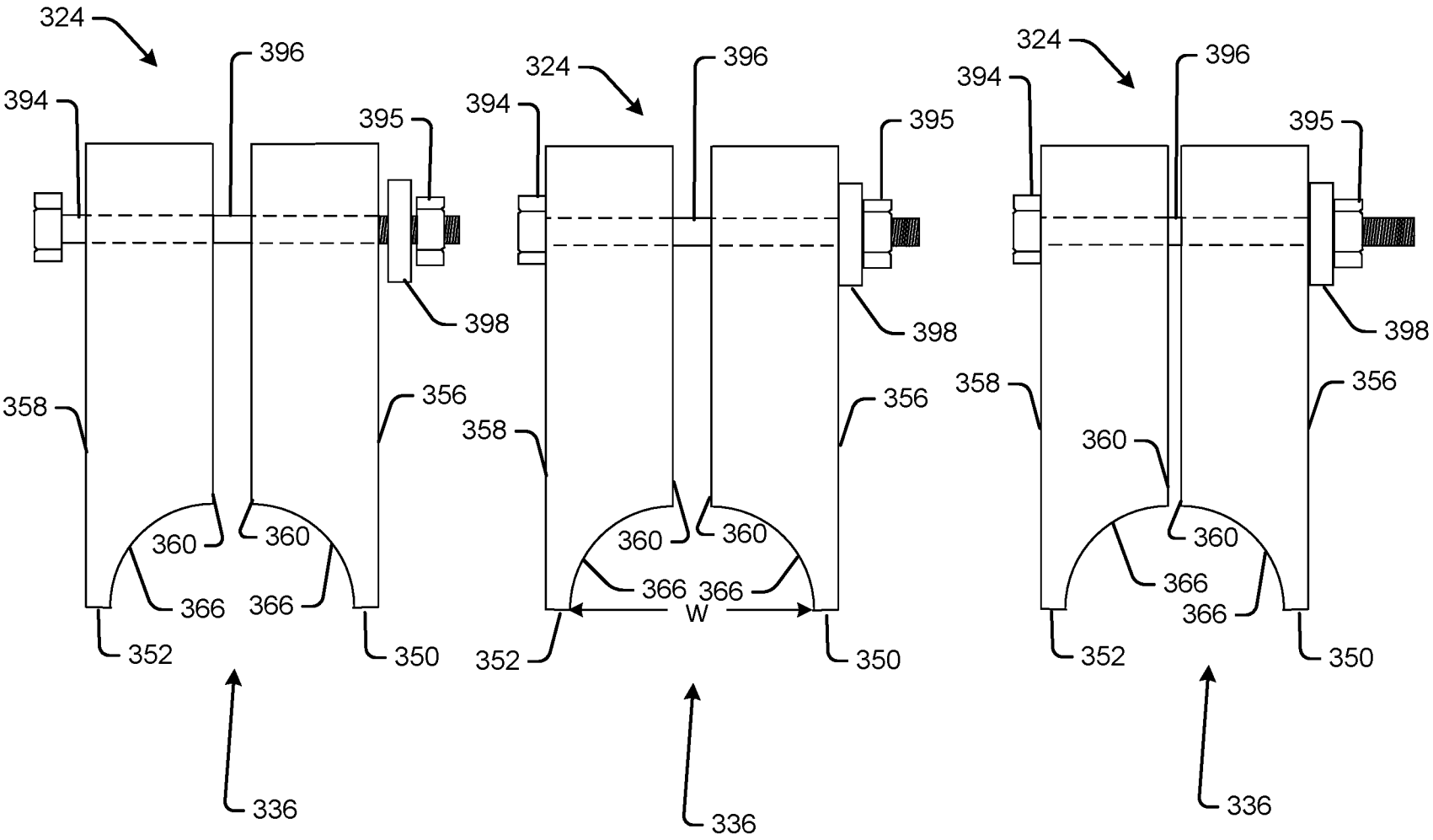
FIG. 14 shows a conduit-bending shoe for a conduit bending apparatus having a shank and another example means associated with the shank for limiting the expansion of the width of the outwardly-opening groove.

FIG. 14 shows the conduit-bending shoe 324 for a conduit bending apparatus of FIG. 13, in which the means for limiting the expansion of the width W includes a spacer-providing mechanism positionable along the length of the shank 394 and between the nut 395 and the head 396 of the fastener 394 to thereby reduce the distance along the length of the elongated shank 394. The spacer-providing mechanism may include a spacer portion 398 that is positionable about a segment of the length of the shank 394 to thereby reduce the distance along the shank 394 that the at least one section 356 and the other section 358 is permitted to travel as the width W of the outwardly-opening groove 336 is expanded.

In an example, the spacer portion 398 is a washer. However, it should be noted that any suitable type and/or number of spacer portion(s) 398 may be provided, including without limitation, one or more washers of one or more different thicknesses, and/or other spacers (e.g., blocks). In addition, the spacer-providing mechanism is not limited to spacer portion 398. Likewise, any suitable spacer-providing mechanism may be provided. An example spacer-providing mechanism is shown in FIGS. 15-20.

Figure 15:
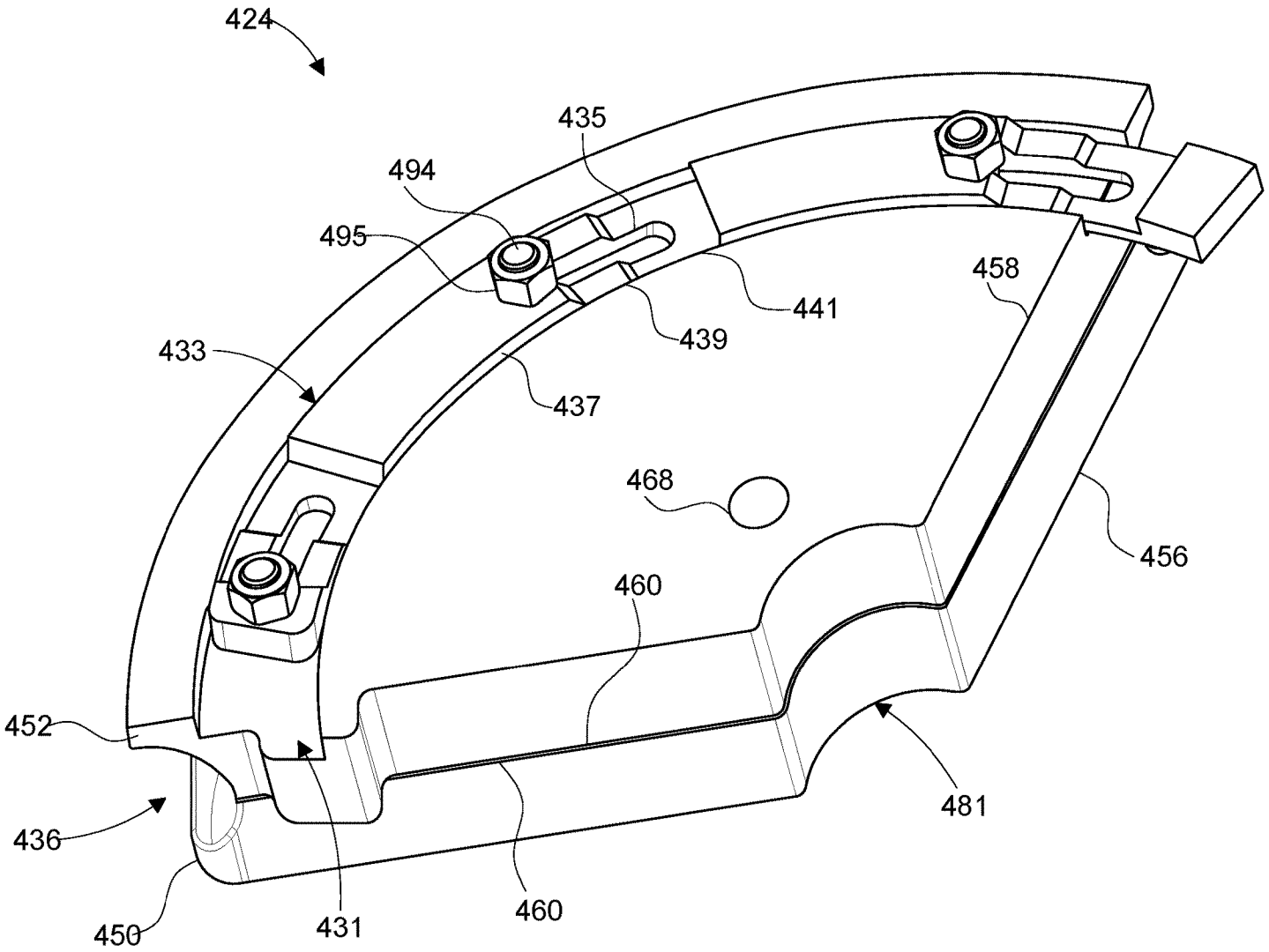
FIG. 15 is a perspective view of two half-sections of another embodiment of the shoe having an adjustment mechanism for controlling predefined spacing between the the side surfaces of the pair of platen half-sections, in a first predetermined setting.

FIG. 15 shows another conduit-bending shoe 424 for a conduit bending apparatus. The conduit-bending shoe 424 includes a plurality of sections 456, 458 arranged adjacent the arcuate-shaped periphery thereof which collectively define the outwardly-opening groove 436 of the shoe 424. One of the sections 456, 458 provides an opposing sidewall of the outwardly-opening groove 436, and another of the sections 456, 458 provides the other opposing sidewall of the outwardly-opening groove 436. The sections 456, 458 are movable relative to one another for altering the width W of the outwardly-opening groove 436.

In FIG. 15, the sections 456, 459 are shown movable relative to one another along the length of at least one shaft or shank 494. The conduit-bending shoe 424 also includes means associated with the shank 494 for limiting the expansion of the width W of the outwardly-opening groove 436. The means for limiting the expansion of the width W is cooperable with the shank 494 for limiting the distance along the length of the shank 494 that the sections 456, 458 are permitted to travel as the width W of the outwardly-opening groove 436 is expanded. By limiting the distance along the length of the shank 494 that at least one of the sections 456, 458 is permitted to travel, the width W of expansion of the outwardly-opening groove 436 is limited as well.

In this embodiment, the spacer-providing mechanism can include a plurality of spacer portions 437, 439, and 441. Each of the spacer portions 437, 439, and 441 are selectively positionable about the shank 494 for occupying a segment of the length of the shank 494 to thereby limit the expansion of the width W of the outwardly-opening groove 436 to a corresponding width so that the mechanism adapts the shoe for use when bending a conduit having an outer diameter which corresponds to any of the widths of the outwardly-opening groove 436 resulting from the positioning of a selected one of the plurality of spacer portions 437, 439, and 441 about the shank 494 as aforesaid.

The spacer portions 437, 439, and 441 each correspond to different widths (W1 in FIG. 16, W2 in FIG. 18, and W3 in FIG. 20) to fit different diameters of industry-standard conduit that can be bent. The spacer-providing mechanism aids the operator in automatically selecting one of the different widths W1, W2, and W3 corresponding to the diameter of the conduit to be bent.

The spacer-providing mechanism includes an elongated body 433 having a length and two opposite side faces. The elongated body 433 defines a through-groove or slot 435 which extends between the opposite side faces and along the length of the body 433 and is cooperable with the shank 494 so that the shank 494 extends through the groove 435. The spacer portions 437, 439, 441 in this embodiment are located at intervals along the length of the body 433 of the spacer-providing mechanism. Each spacer portion 437, 439, 441 possesses a thickness as measured between the opposite side faces of the elongated body 433.

The elongated body 433 can be slidably moveable relative to the shank 494 as the elongated body 433 is guided along the through-groove 435. By slidably moving the elongated body 433 relative to the shank 494 so that a selected one of the spacer portions 437, 439, 441 occupies a segment of the length of the shank 494, the shoe 424 is capable of use when bending a conduit having an outer diameter which corresponds with the maximum width of the outwardly-opening groove 436 resulting from the positioning of the selected one of the spacer portions 437, 439, 441 about the shank 494 as aforesaid.

In an example, the elongated member 433 can include a first spacer portion 437 having a thickness as measured between the two opposite side faces of the elongated member 433 and which is positionable about the shank 494 for reducing the permitted path of travel of the sections 456, 458 along length of the shank 494 during an expansion of the width of the outwardly-opening groove 436 by the thickness of the first spacer portion 437.

The elongated member 433 can also include a second spacer portion 439 having a thickness as measured between the two opposite side faces of the elongated member 433 and which is positionable about the shank 494 for reducing the permitted path of travel of the sections 456, 458 along the shank 494 during an expansion of the width of the outwardly-opening groove 436 by the thickness of the first spacer portion 439.

The elongated member 433 can also include a third spacer portion 441 disposed along the length thereof and having a thickness as measured between the opposite side faces of the elongated member 433. The thickness of the third spacer 441 can be different in magnitude from the thickness of the first spacer portion 437 and the thickness of the second spacer portion 439. The elongated member 433 moves relative to the shank 494 so that the third spacer section 441 is disposed along the permitted path of travel of at least one of the sections along the length of the shank 494 during an expansion of the width of the outwardly-opening groove 436. The permitted travel of at least one of the sections along the length of the shank 494 is reduced by the thickness of the third spacer portion 441.

The thicknesses of the first spacer section 437, second spacer section 439 and third spacer section 441 can be stepped in magnitude so that the second thickness is greater than the first thickness and the third thickness is greater than the second thickness.

Example operations are illustrated by FIGS. 15-20. In an example, the conduit-bending shoe 424 is mounted for rotation about an axis (e.g., axis 25 in FIG. 1). The shoe 424 has an arcuate-shaped periphery defining an outwardly-opening groove 436 having opposing sidewalls 450, 452 for accepting the outer surface of a conduit desired to be bent. The outwardly-opening groove 436 has a variable width (e.g., W1 in FIG. 16, W2 in FIG. 18, and W3 in FIG. 20) as measured laterally across the opening thereof and which accepts the outer surface of different diameters of conduit, each having a predetermined outer diameter. By positioning the outwardly-opening groove 436 of the shoe 424 about the conduit, the outer surface of the conduit is accepted by the outwardly-opening groove 436 and the shoe 424 is pressed against the conduit while rotating the shoe 424 about its axis of rotation to form a bend in the conduit.

The spacing between the side surfaces 460 of the pair of platen half-sections 456, 458 is controlled by the spacer-providing mechanism to set the variable width (W1, W2, or W3) for the diameter of the conduit to be bent. The variable width of the outwardly-opening groove 436 of the shoe 424 accepts the conduit regardless of which of the different diameters of conduit is provided, without having to replace the shoe or provide separate shoes for each industry size diameter conduit.

Figure 16:
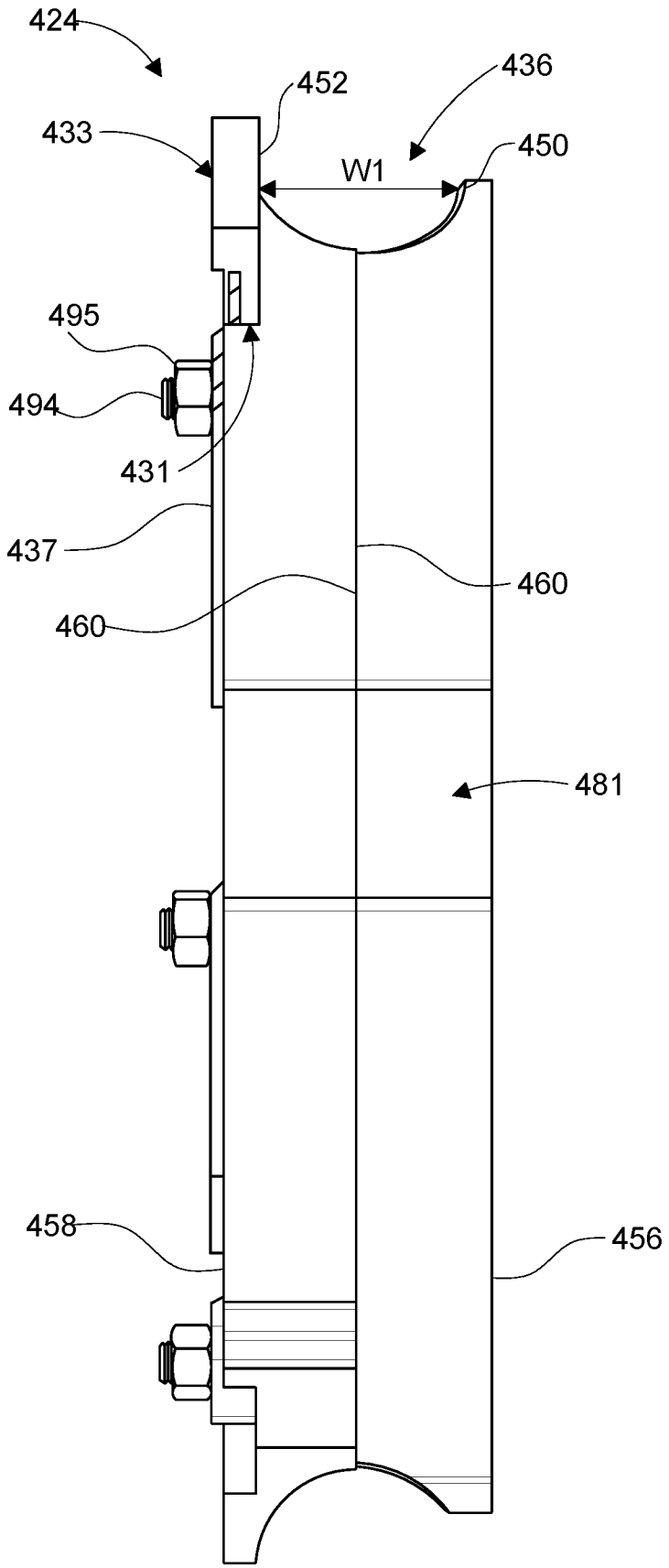
FIG. 16 is a side view of the side surfaces of the pair of platen half-sections corresponding to FIG. 15.

In FIG. 15, the spacer-providing mechanism is in a first predetermined setting corresponding to spacing W1 (FIG. 16). FIG. 16 is a side view showing the side surfaces 460 of the pair of platen half-sections 456, 458 with spacing W1 corresponding to FIG. 15. In an example, the spacer-providing mechanism is adapted to control movement of the opposing sidewalls 450, 452 of the outwardly-opening groove 436 relative to one another to accommodate a preset alteration in the variable width (e.g., W1 in FIG. 16, W2 in FIG. 18, and W3 in FIG. 20) of the outwardly-opening groove 436.

In an example, the spacer-providing mechanism includes at least one spacer portion to accommodate a change in the variable width (e.g., W1 in FIG. 16, W2 in FIG. 18, and W3 in FIG. 20) of the outwardly-opening groove 436. Three spacer portions are provided in this example. The spacer portions correspond to step 437 (Step 1), step 439 (Step 2), and step 441 (Step 3). It is noted, however, that any number (one or more) steps can be provided. The spacer portions 437, 439, and 441 correspond to selections from industry-standard conduit diameters.

Figure 17A:
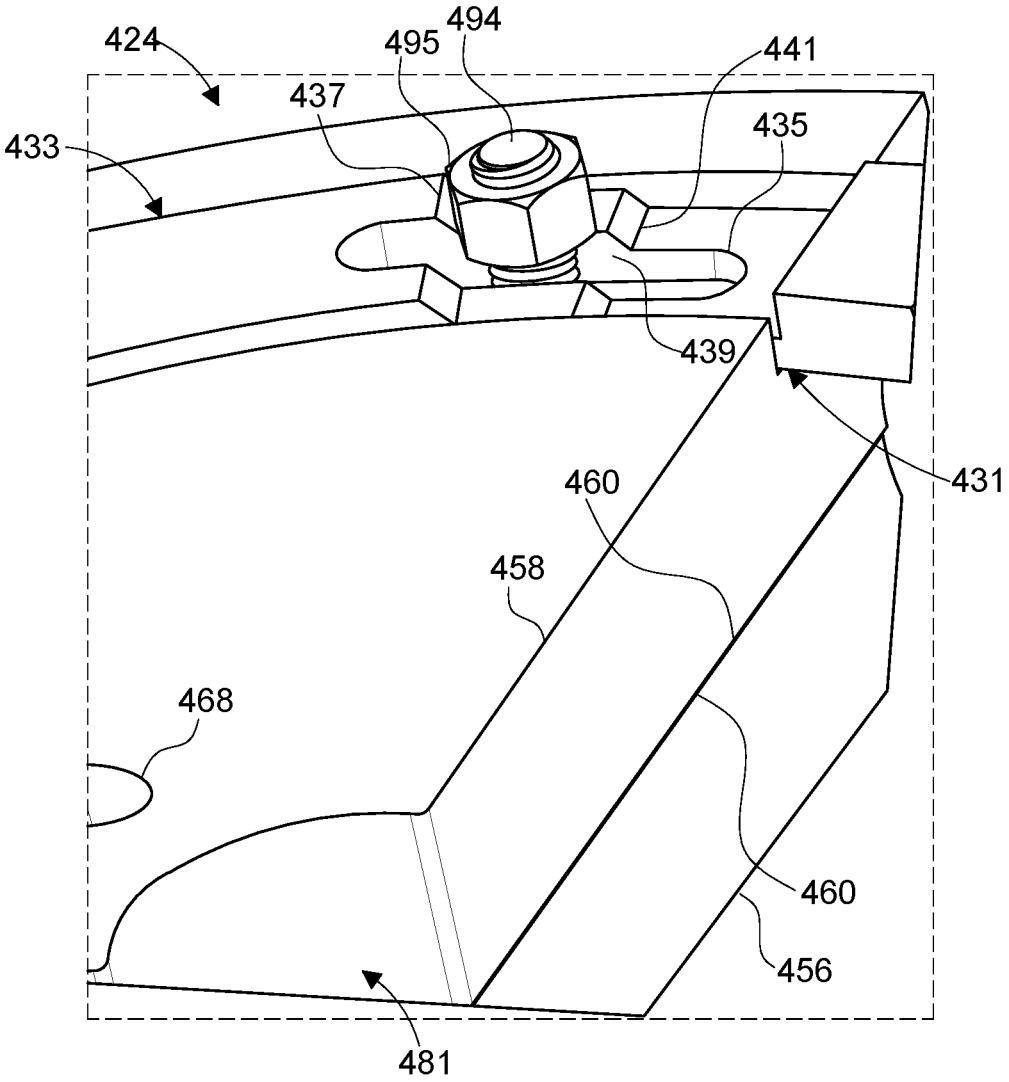
FIGS. 17A and 17B are perspective views of the two half-sections of the shoe corresponding to FIG. 15, illustrating operation of the adjustment mechanism for controlling predefined spacing between the the side surfaces of the pair of platen half-sections, in a second predetermined setting.
Figure 17B:
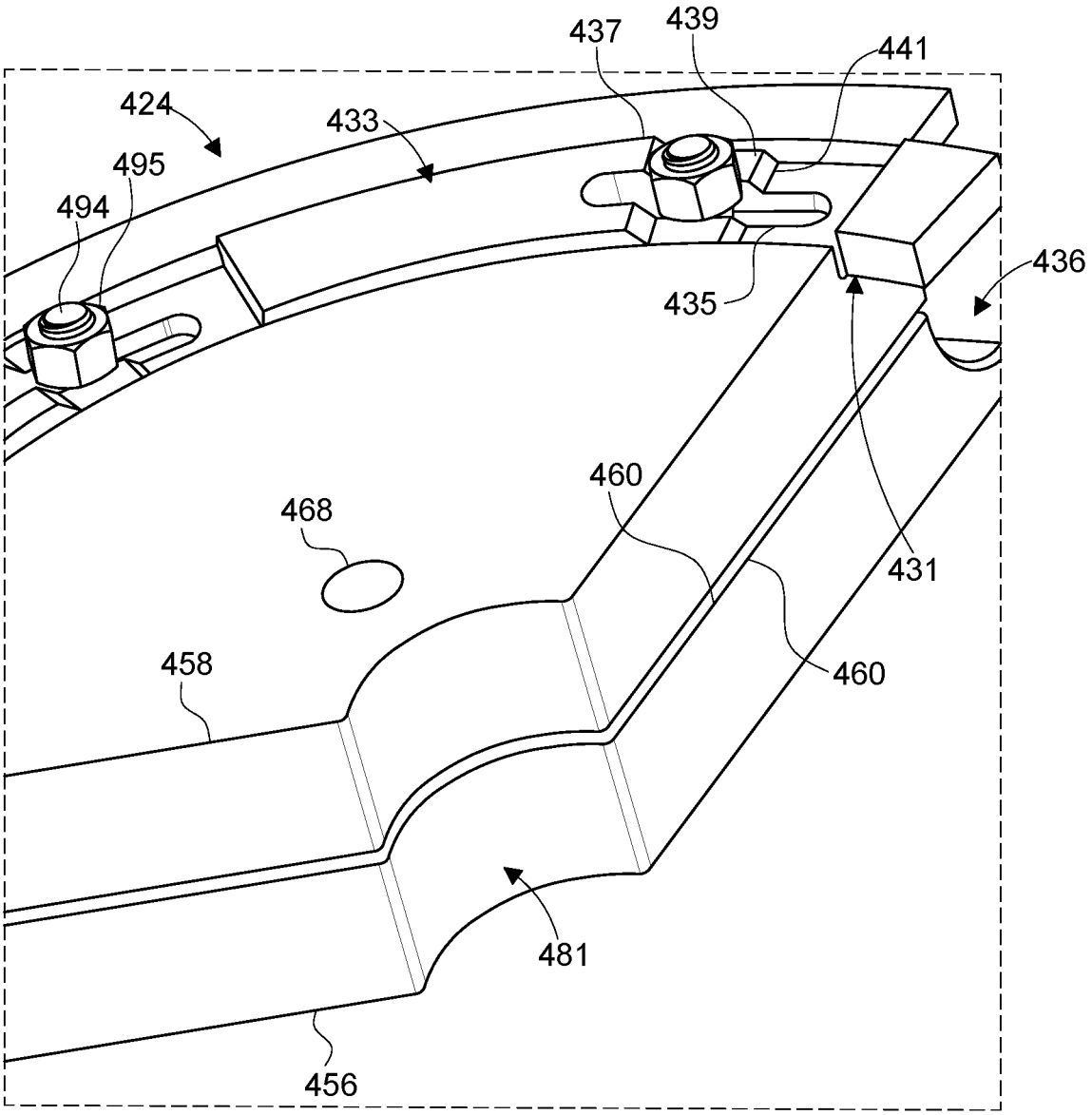
Figure 18:
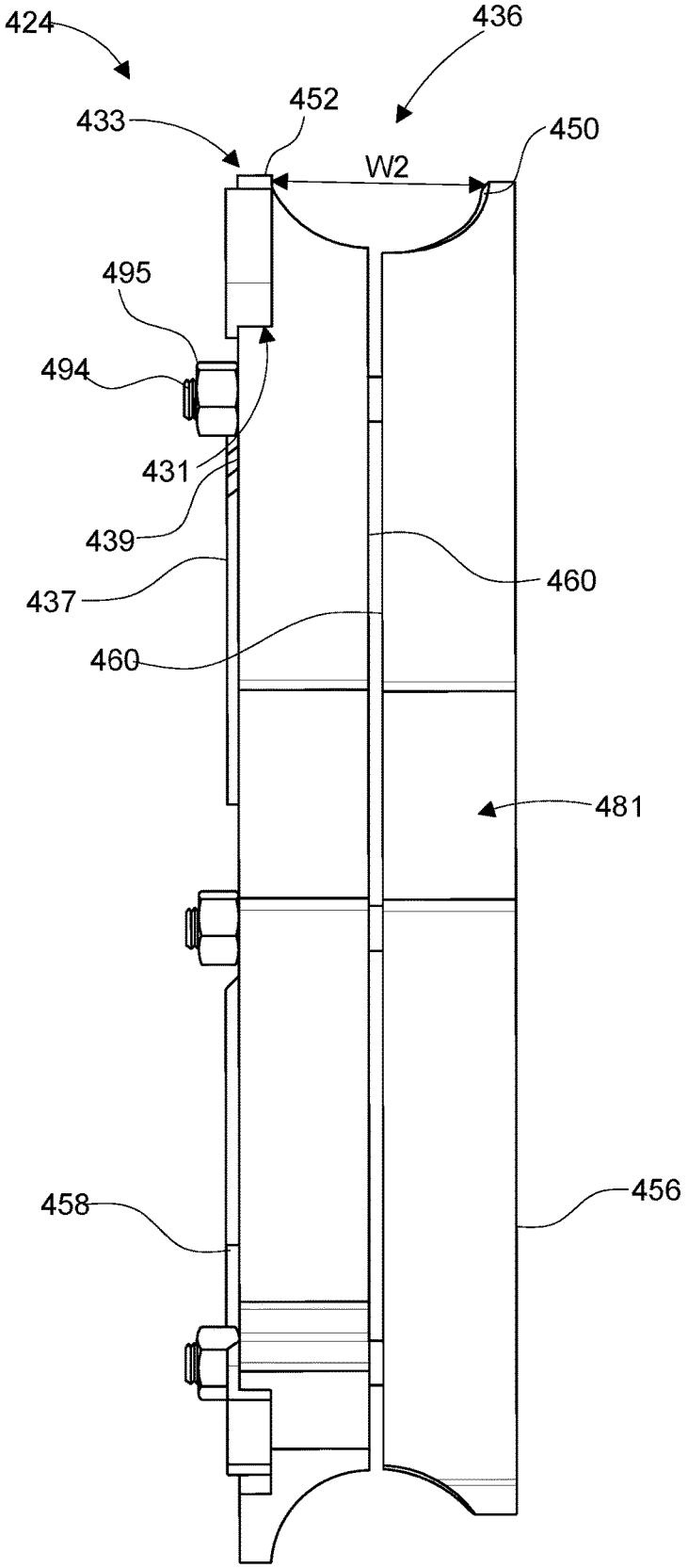
FIG. 18 is a side view of the side surfaces of the pair of platen half-sections corresponding to FIG. 17B.
Figure 19:
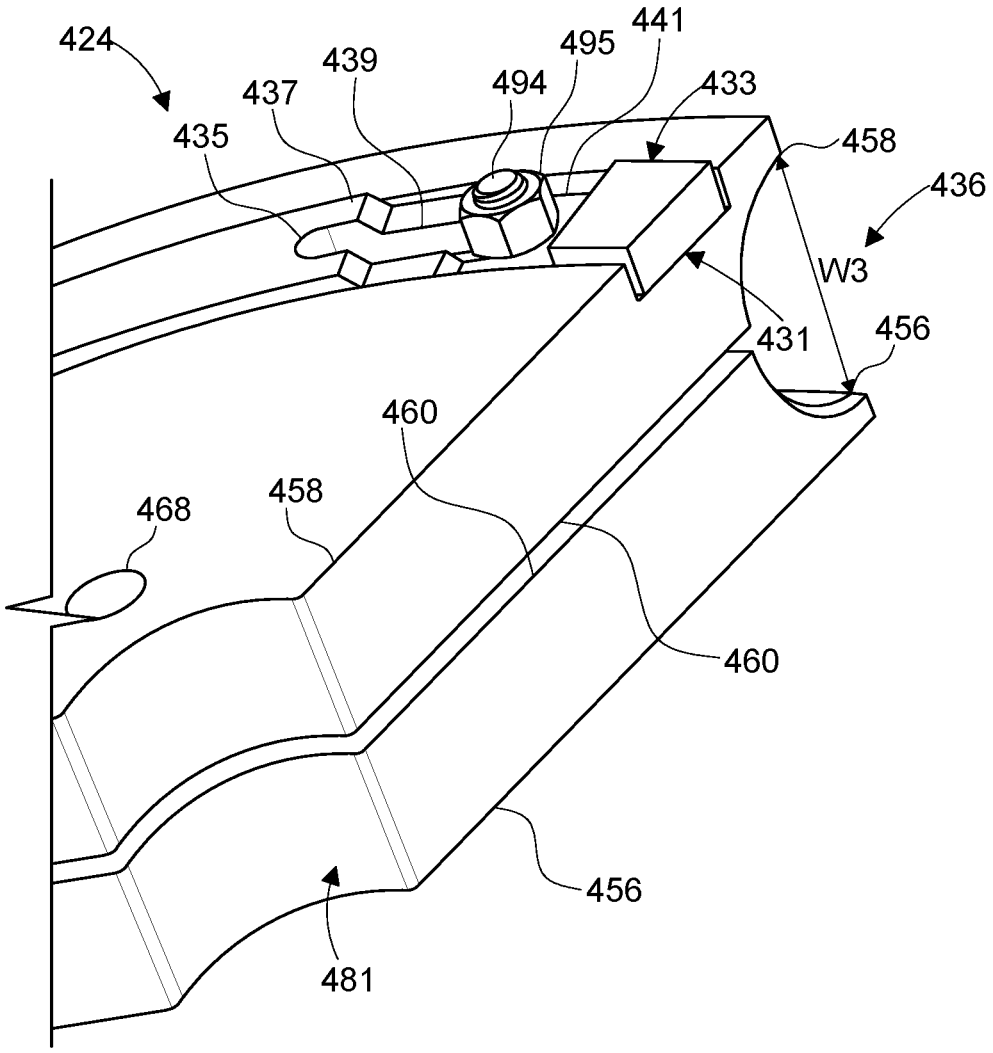
FIG. 19 is a perspective view of two half-sections of the shoe corresponding to FIG. 15 wherein the adjustment mechanism for controlling predefined spacing between the the side surfaces of the pair of platen half-sections is in a third predetermined setting.
Figure 20:
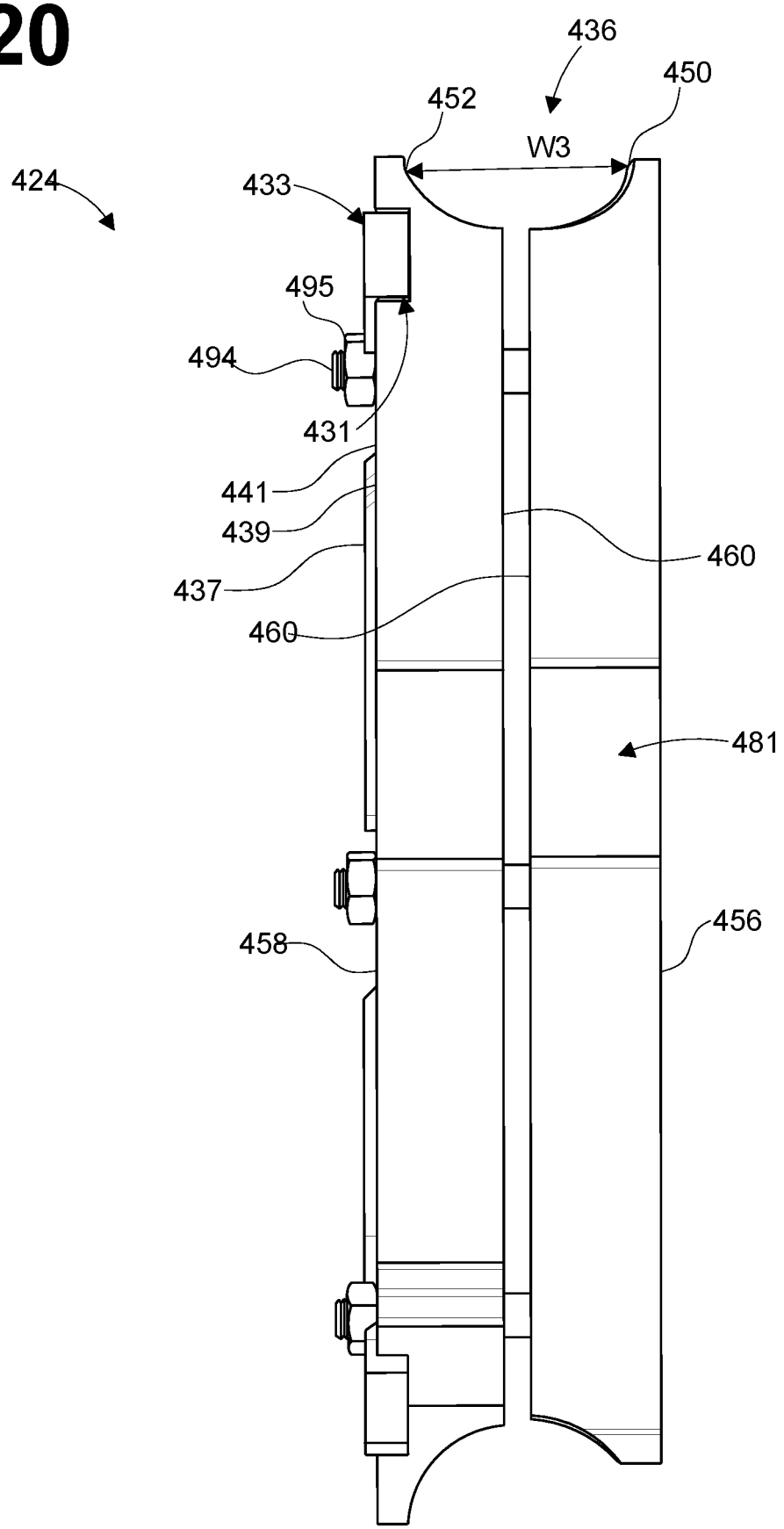
FIG. 20 is a side view of the side surfaces of the pair of platen half-sections corresponding to FIG. 19.

The spacer portions 437, 439, and 441 can be selected based on the diameter of the conduit that is desired to be bent. FIGS. 17A and 17B show the platen half-sections 456, 458 of the shoe 424 and operation of the spacer-providing mechanism for selecting the width W2 seen in FIG. 18. FIG. 19 shows the platen half-sections 456, 458 of the shoe 424 and operation of the spacer-providing mechanism for selecting the width W3 seen in FIG. 20.

In an example, the spacer portion 437 corresponding to width W1 is adjacent to another spacer portion 439 corresponding to width W2. The spacer portion 439 is also adjacent to the spacer portion 441 corresponding to width W3. Each of the spacer portions 437, 439, and 441 are arranged in successive steps relative to immediately adjacent spacer portions, and correspond to different industry-standard conduit diameters. It is noted, however, that any number of spacer portions can be provided, and in any orientation and/or configuration, and are not limited to the number, orientation and/or configuration shown in the drawings.

In an example, a slot 435 is formed in the spacer-providing mechanism. The slot 134 is formed through each of the plurality of spacer portions 437, 439, and 441. The shaft or shank 494 is slidable along at least a part or portion of the slot 435 to engage with the spacer portions 437, 439, and 441 and accommodate a corresponding one of the variable widths W1, W2, W3 of the outwardly-opening groove 436 for different industry-standard conduit diameters. A position of the shank 494 in the slot 435 determines which of the plurality of spacer portions 437, 439, and 441 is active or engaging with the spacer-providing mechanism (e.g., nut 495 or head 496 of the bolt).

In an example, the spacing preset mechanism also includes a glide track 431 and a glide member 433 configured to slide within the glide track 431. The spacer portions 437, 439, and 441 are formed on the glide track 431. The glide track 431 and the glide member 433 are shown as these are arcuate in shape, which can follow along the arcuate-shaped periphery of the shoe 424. It is noted, however, that any suitable shape and/or configuration of the glide track 431 and glide member 433 can be provided, including but not limited to, a straight or L-shaped glide track.

The shaft or the shank 194 is slidable through at least a part of the slot 435 to engage with the spacer portions 437, 439, and 441, which can be selected according to which of the different industry-standard conduit diameters is desired to be bent during the conduit bending operation.

In an example, the slot 435 is formed through each of the spacer portions 437, 439, and 441 in the glide track 431. The position of the shank 194 in the slot 435 determines which of the spacer portions 437, 439, and 441 is engaged to select a corresponding variable width W1, W2, W3 for different industry-standard conduit diameters.

In an example, each of the spacer portions 437, 439, and 441 in the glide track 431 are arranged in successive steps on the glide member 433. Each of the successive steps corresponds to a respective one of the preset alterations in the variable width W1, W2, W3 for different industry-standard conduit diameters.

Accordingly, the aforedescribed embodiments are intended for the purpose of illustration and not as limitation.

The invention claimed is:

1. In a conduit bending apparatus having a conduit-bending shoe mounted for rotation about an axis and having an arcuate-shaped periphery defining an outwardly-opening groove having opposing sidewalls for accepting an outer surface of a conduit to be bent, wherein the outwardly-opening groove has a width as measured laterally across an opening thereof so that by positioning the outwardly-opening groove of the shoe about the conduit such that the outer surface of the conduit is accepted by the outwardly-opening groove and then pressing the shoe against the conduit while rotating the shoe about the axis so that the outwardly-opening groove rolls along a length of the conduit, a bend is formed in the conduit, the improvement characterized in that:

the shoe is comprised of a first section and a second section having the arcuate-shaped periphery and collectively defining the outwardly-opening groove of the shoe, wherein the first section provides one of the opposing sidewalls of the outwardly-opening groove and the second section provides the other of the opposing sidewalls of the outwardly-opening groove, and the first and second sections are movable relative to one another for altering the width of the outwardly-opening groove;

a shank having a length and which is adapted to cooperate with the first and second sections so that as the first and second sections are moved relative to one another to alter the width of the outwardly-opening groove, at least one of the first and second sections is permitted to travel along the length of the shank; and a mechanism associated with the shank for limiting the expansion of the width of the outwardly-opening groove; wherein the mechanism is in the form of an elongated body defining a through-groove.

2. The improvement as defined in claim 1 wherein the mechanism for limiting is cooperable with the shank for limiting a distance along the length of the shank that the at least one of the first and second sections is permitted to travel as the width of the outwardly-opening groove is expanded, thereby limiting the expansion of the outwardly-opening groove.

3. The improvement as defined in claim 2 wherein the mechanism includes a spacer portion which is positionable about a segment of the length of the shank to thereby reduce the distance along the shank that the at least one of the first and second sections is permitted to travel as the width of the outwardly-opening groove is expanded.

4. The improvement as defined in claim 3 wherein the spacer portion includes a plurality of spacer portions which are each selectively positionable about the shank for occupying a segment of the length of the shank to thereby limit the expansion of the width of the outwardly-opening groove to a corresponding width of each of the plurality of spacer portions so that the mechanism adapts the shoe for use when bending a conduit having an outer diameter which corresponds to any of the widths of the outwardly-opening groove resulting from positioning a selected one of the plurality of spacer portions about the shank.

5. The improvement as defined in claim 4 wherein the elongated body has a length and two opposite side faces, and the through-groove extends between the opposite side faces and along the length of the body and is cooperable with the shank so that the shank extends through the through-groove, and the plurality of spacer portions are located at intervals along the length of the body of the mechanism and each spacer portion possesses a thickness as measured between the opposite side faces of the body, and the body of the mechanism is slidably moveable relative to the shank as the body of the mechanism is guided along the through-groove so that by slidably moving the body of the mechanism relative to the shank so that a selected one of the plurality of spacer portions occupies a segment of the length of the shank, the shoe is capable of use when bending a conduit having an outer diameter which corresponds with a maximum width of the outwardly-opening groove resulting from the positioning of the selected one of the plurality of spacer portions about the shank.

6. The improvement as defined in claim 4 wherein the elongated body has a length, two opposite side faces and the through-groove opens out of each of the side faces of the elongated body and extends along the length of the elongated body;

the shank extends through the through-groove of the elongated body to permit movement of the elongated body relative to the shank; and the elongated body further includes a) a first spacer portion of the plurality of spacer portions having a thickness as measured between the two opposite side faces of the elongated member and which is positionable about the shank for reducing a permitted path of travel of the at least one of the first and second sections along the shank during an expansion of the width of the outwardly-opening groove by an amount corresponding to the thickness of the first spacer portion; and b) a second spacer portion of the plurality of spacer portions having a thickness as measured between the two opposite side faces of the elongated body and which is positionable about the shank for reducing the permitted path of travel of the at least one of the first and second sections along the shank during an expansion of the width of the outwardly-opening groove by an amount corresponding to the thickness of the second spacer section.

7. The improvement as defined in claim 6 wherein the elongated body includes a third spacer portion disposed along the length thereof and having a thickness as measured between the opposite side faces of the elongated body and wherein the thickness of the third spacer is different in magnitude from the thickness of first spacer portion and the thickness of the second spacer portion so that by moving the elongated body relative to the shank so that the third spacer section is disposed along the permitted path of travel of the at least one of the first and second sections along the length of the shank during an expansion of the width of the outwardly-opening groove, the permitted path of travel of the at least one of the first and second sections along the length of the shank is reduced by the thickness of the third spacer portion.

8. The improvement as defined in claim 7 wherein the thicknesses of the first, second and third spacer sections are stepped in magnitude so that the second thickness is greater than the first thickness and the third thickness is greater than the second thickness.

9. In a conduit bending apparatus having a conduit-bending shoe mounted for rotation about an axis and having an arcuate-shaped periphery defining an outwardly-opening groove having opposing sidewalls for accepting an outer surface of a conduit to be bent, wherein the outwardly-opening groove has a width as measured laterally across an opening thereof so that by positioning the outwardly-opening groove of the shoe about the conduit such that the outer surface of the conduit is accepted by the outwardly-opening groove and then pressing the shoe against the conduit while rotating the shoe about the axis so that the outwardly-opening groove rolls along a length of the conduit, a bend is formed in the conduit, the improvement characterized in that:

the shoe is comprised of a first section and a second section having the arcuate-shaped periphery and collectively defining the outwardly-opening groove of the shoe, wherein the first section provides one of the opposing sidewalls of the outwardly-opening groove and the second section provides the other of the opposing sidewalls of the outwardly-opening groove, and the first and seconds sections are joined together in a manner which permits the opposing sidewalls of the outwardly-opening groove to be moved away from one another for expanding the width of the outwardly-opening groove;

an elongated shank having a length which extends through the first and second sections and which is adapted to cooperate with the first and second sections so that as the first and second sections are moved relative to one another to alter the width of the outwardly-opening groove, at least one of the first and second sections is permitted to travel along the length of the shank; and a spacer-providing mechanism associated with the shank for limiting the expansion of the width of the outwardly-opening groove by limiting a distance along the length of the shank that the at least one of the first and second sections is permitted to travel; wherein the spacer-providing mechanism is in the form of an elongated body defining a through-groove.

10. The improvement as defined in claim 9 wherein the shank is a fastener having a head at one end of the shank and a nut at another end of the shank opposite the one end, and the at least one of the first and second sections is permitted to travel along the length of the shank and between the nut and the head as the width of the outwardly-opening groove is altered, and the spacer-providing mechanism is positionable along the length of the shank and between the nut and the head of the fastener to thereby reduce the distance along the length of the shank that the at least one of the first and second sections is permitted to travel as the width of the outwardly-opening groove is altered.

11. The improvement as defined in claim 10 wherein the through-groove extends along a length of the body and is permitted to be shifted in position relative to the first and second sections, and the body of the spacer-providing mechanism includes at least one spacer portion along the length of the body which is positionable along the length of the shank for occupying a segment of the length of the shank and thereby limiting the distance along the length of the shank that the at least one of the first and second sections is permitted to travel as the width of the outwardly-opening groove is altered.

12. The improvement as defined in claim 11 wherein the at least one spacer portion includes a plurality of spacer portions disposed along the length of the body and each of the plurality of spacer portions is selectively positionable along a segment of the length of the shank to thereby reduce the distance along the length of the shank that the at least one of the first and second sections is permitted to travel as the width of the outwardly-opening groove is altered, so that the spacer-providing mechanism is capable of adapting the width of the outwardly-opening groove to accept any of a number of conduits having an outer diameter within a range of outer diameters provided by the number of conduits.

13. In a conduit bending apparatus having a conduit bending shoe which is mounted for rotation about an axis and having an arcuate-shaped periphery defining an outwardly-opening groove which extends there-along and having two opposing sidewalls for accepting an outer surface of a conduit to be bent and wherein the outwardly-opening groove has a width as measured laterally across an opening thereof so that by positioning the outwardly-opening groove of the periphery about the outer surface of the conduit and then pressing the shoe against the conduit while rotating the shoe about the axis so that the outwardly-opening groove rolls axially along the conduit, a bend is formed in the conduit, the improvement characterized in that:

the shoe has an imaginary mid-plane which bisects the outwardly-opening groove between the opposing sidewalls thereof; and the shoe includes a first platen half-section which is arranged on one side of the mid-plane and includes a second platen half-section which is arranged on the other side of the mid-plane; and the first and second platen half-sections collectively provide the outwardly-opening groove which extends along the periphery of the shoe, wherein the first platen half-section defines one of the opposing sidewalls of the outwardly-opening groove and the second platen half-section defines the other of the opposing sidewalls of the outwardly-opening groove;

the first and second platen half-sections are joined together in a manner which accommodates a spreading apart of the platen half-sections at the periphery of the shoe so that asthe first and second platen half-sections are spread apart, the width of the outwardly-opening groove expands by a corresponding amount;

wherein the first and second platen half-sections define at least one set of aligned through-openings which extend through the first and second platen half-sections along a path which is substantially parallel to the rotation axis of the shoe, and the first and second platen half-sections are joined together with a bolt having a head, a shank which extends through the at least one set of aligned through-openings and a nut which is threaded about the shank of the bolt, and wherein at least one of the first and second platen half-sections travel along a length of the shank of the bolt as the first and second platen half-sections are spread apart to expand the width of the outwardly-opening groove; and a mechanism cooperable with the bolt for limiting a distance along the length of the shank that the at least one of the first and second platen half-sections are capable of traveling to thereby limit the width to which the outwardly-opening groove is capable of expanding; wherein the mechanism is in the form of an elongated body defining a through-groove.

14. The improvement as defined in claim 13 wherein the mechanism includes a spacer portion which is positionable about a segment of the length of the shank to thereby reduce the distance along the shank that the at least one of the first and second platen half-sections is permitted to travel as the width of the outwardly-opening groove is expanded.

15. The improvement as defined in claim 14 wherein the spacer portion includes a plurality of spacer portions which are each selectively positionable about the shank for occupying a segment of the length of the shank to thereby limit an expansion of the width of the outwardly-opening groove to a corresponding width so that the mechanism adapts the shoe for use when bending a conduit having an outer diameter which corresponds to any of the widths of the outwardly-opening groove resulting from positioning a selected one of the plurality of spacer portions about the shank.

16. The improvement as defined in claim 15 wherein the elongated body has a length and two opposite side faces, and the through-groove extends between the opposite side faces and along the length of the body and is cooperable with the shank so that the shank extends through the through-groove, and the plurality of spacer portions are located at intervals along the length of the body of the mechanism and each spacer portion possesses a thickness as measured between the opposite side faces of the body, and the body of the mechanism is slidably moveable relative to the shank so that by slidably moving the body of the mechanism relative to the shank so that a selected one of the plurality of spacer portions occupies a segment of the length of the shank, the shoe is capable of bending a conduit having an outer diameter which corresponds with the width of the outwardly-opening groove resulting from the positioning of the selected one of the plurality of spacer portions about the shank.

* * * * *